US007003238B2

(12) United States Patent
Yoshida et al.

(10) Patent No.: US 7,003,238 B2
(45) Date of Patent: Feb. 21, 2006

(54) INTERMEDIATE IMAGE TRANSFER DEVICE FOR A COLOR IMAGE FORMING APPARATUS

(75) Inventors: Ken Yoshida, Tokyo (JP); Yuuji Sawai, Kanagawa (JP); Hiromi Ogiyama, Tokyo (JP); Atsushi Takehara, Kanagawa (JP); Shin Kayahara, Chiba (JP); Shinji Kato, Kanagawa (JP); Yoshihiro Fujiwara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 184 days.

(21) Appl. No.: 10/700,486

(22) Filed: Nov. 5, 2003

(65) Prior Publication Data

US 2004/0136760 A1 Jul. 15, 2004

(30) Foreign Application Priority Data

Nov. 5, 2002 (JP) ..... 2002-321776
Feb. 20, 2003 (JP) ..... 2003-042258

(51) Int. Cl.
*G03G 15/01* (2006.01)
*G03G 15/16* (2006.01)

(52) U.S. Cl. ..... 399/66; 399/302; 399/314

(58) Field of Classification Search ..... 399/66, 399/298, 299, 302, 303, 308, 310, 313, 314
See application file for complete search history.

(56) References Cited

U.S. PATENT DOCUMENTS 5,946,538 A * 8/1999 Takeuchi et al. ..... 399/302
6,006,062 A 12/1999 Takahashi et al. ..... 399/310
6,195,519 B1 2/2001 Isobe et al.
6,212,351 B1 4/2001 Kawagoe et al.
6,295,438 B1 9/2001 Fujishiro et al.
6,334,039 B1 12/2001 Yoshinaga et al.

(Continued)

FOREIGN PATENT DOCUMENTS

JP 3-231783 10/1991

OTHER PUBLICATIONS

European Search Report.

*Primary Examiner*—Willliam J. Royer
(74) *Attorney, Agent, or Firm*—Oblon, Spivak, McClelland, Maier & Neustadt, P.C.

(57) ABSTRACT

An intermediate image transfer type of image forming apparatus of the present invention includes an image carrier, an intermediate image transfer body, primary image transferring means for transferring a toner image from the image carrier to the intermediate image transfer body, and secondary image transferring means for transferring the toner image from the intermediate image transfer body to a sheet. When the surface resistivity of the intermediate image transfer body is measured by a method that repeatedly applies a voltage of 200 V for 60 seconds to the intermediate image transfer body and grounds the intermediate image transfer body for 10 seconds 1,000 consecutive times, a difference in absolute value between the logarithm of the first time of measurement and that of the thousandth time of measurement is 0.5 log Ω/□ or below.

69 Claims, 34 Drawing Sheets

U.S. PATENT DOCUMENTS 6,366,754 B1 4/2002 Sato et al.
6,405,002 B1 6/2002 Ogiyama et al.
6,516,179 B1 2/2003 Sawai et al.
6,526,235 B1 2/2003 Kato
6,594,453 B1 7/2003 Kato
6,597,881 B1 7/2003 Hatori et al.
6,611,672 B1 8/2003 Aoki et al.
6,618,565 B1 9/2003 Sawai et al.
6,654,574 B1 11/2003 Kayahara et al.
6,701,100 B1 * 3/2004 Tamiya et al. ..... 399/66
6,904,255 B1 * 6/2005 Kera et al. ..... 399/299
2003/0180057 A1 9/2003 Sawada et al.

* cited by examiner

FIG. 3

| BELT NO. | SURFACE RESISTIVITY VARIATION IN ABSOLUTE VALUE log (Ω/□) | TRANSFERABILITY RANK |
|---|---|---|
| 1 | 0.01 | 5 |
| 2 | 0.28 | 5 |
| 3 | 0.45 | 4.5 |
| 4 | 0.50 | 4 |
| 5 | 0.55 | 3.5 |

FIG. 5

| BELT NO. | SURFACE RESISTIVITY VARIATION IN ABSOLUTE VALUE log (Ω/□) | TRANSFERABILITY RANK |
|---|---|---|
| 6 | 0.1 | 5 |
| 7 | 0.25 | 5 |
| 8 | 0.44 | 4.5 |
| 9 | 0.49 | 4 |
| 10 | 0.56 | 3.5 |

FIG. 9

| BELT NO. | VOLUMETRIC RESISTIVITY VARIATION IN ABSOLUTE VALUE log (Ω/□) | TRANSFERABILITY RANK |
|---|---|---|
| 11 | 0.74 | 5 |
| 12 | 1.18 | 5 |
| 13 | 1.79 | 4.5 |
| 14 | 2.11 | 4 |
| 15 | 2.80 | 3.5 |

FIG. 11

| BELT NO. | VOLUMETRIC RESISTIVITY VARIATION IN ABSOLUTE VALUE log (Ω/□) | TRANSFERABILITY RANK |
|---|---|---|
| 16 | 0.11 | 5 |
| 17 | 1.09 | 5 |
| 18 | 2.08 | 4 |
| 19 | 2.53 | 3.5 |

FIG. 14

| BELT NO. | BIAS CONTROL | IMAGE AREA RATIO | IMAGE DENSITY |
|---|---|---|---|
| 20 | CONSTANT VOLTAGE | 5% | ○ |
| | | 95% | ○ |
| | CONSTANT CURRENT | 5% | × |
| | | 95% | ○ |

FIG. 17

| BELT NO. | 5-SECOND POTENTIAL [V] | T-SECOND POTENTIAL [V] | IRREGULARITY |
|---|---|---|---|
| 1 | 481 | 489 | × |
| 2 | 436 | 467 | × |
| 3 | 207 | 268 | △ |
| 4 | 134 | 171 | ○ |
| 5 | 151 | 173 | ○ |
| 6 | 11 | 16 | ○ |

FIG. 19

| BELT NO. | INNER SURFACE RESISTIVITY [Ω/□] | 5-SECOND POTENTIAL [V] | T-SECOND POTENTIAL [V] | THICKNESS [μm] | TRANSFER RATIO | DISCHARGE MARK |
|---|---|---|---|---|---|---|
| 7 | $8.90 \times 10^{6}$ | 15 | 20 | 78.0 | × | ○ |
| 8 | $1.22 \times 10^{7}$ | 22 | 32 | 80.2 | △ | ○ |
| 9 | $1.29 \times 10^{8}$ | 20 | 40 | 86.0 | ○ | ○ |
| 10 | $1.04 \times 10^{9}$ | 481 | 489 | 100.5 | ○ | ○ |
| 11 | $2.00 \times 10^{9}$ | 35 | 48 | 81.6 | ○ | ○ |
| 12 | $9.77 \times 10^{9}$ | 183 | 207 | 100.2 | ○ | ○ |
| 13 | $1.17 \times 10^{10}$ | 436 | 467 | 79.6 | ○ | ○ |
| 14 | $7.21 \times 10^{11}$ | 120 | 162 | 80.6 | ○ | △ |
| 15 | $5.88 \times 10^{12}$ | 201 | 222 | 112.3 | ○ | × |

FIG. 21

| BELT NO. | INNER SURFACE RESISTIVITY [Ω/□] | 5-SECOND POTENTIAL [V] | T-SECOND POTENTIAL [V] | THICKNESS [μm] |
|---|---|---|---|---|
| 16 | $1.29 \times 10^{8}$ | 20 | 40 | 86.0 |
| 17 | $2.00 \times 10^{9}$ | 35 | 48 | 81.6 |
| 18 | $1.17 \times 10^{10}$ | 88 | 101 | 79.6 |
| 19 | $1.38 \times 10^{11}$ | 101 | 135 | 80.6 |
| 20 | $9.77 \times 10^{9}$ | 183 | 207 | 100.2 |
| 21 | $1.04 \times 10^{9}$ | 481 | 489 | 100.5 |

FIG. 25

| | BELT NO.18 | | BELT NO.20 | | BELT NO.17 | | BELT NO.19 | | BELT NO.21 | | BELT NO.16 | |
|---|---|---|---|---|---|---|---|---|---|---|---|---|
| | M/A | STACK SCATTE-RING | M/A | STACK SCATTE-RING | M/A | STACK SCATTE-RING | M/A | STACK SCATTE-RING | M/A | STACK SCATTE-RING | M/A | STACK SCATTE-RING |
| 90% | 1.75 | 2.5 | | | 1.52 | 4 | 1.55 | 3.5 | | | | |
| 80% | 1.66 | 3 | 1.70 | 3 | 1.36 | 4.25 | 1.43 | 4 | 1.69 | 4 | 1.60 | 3 |
| 70% | 1.57 | 3.5 | 1.56 | 3.5 | 1.21 | 4.5 | 1.27 | 4.25 | 1.52 | 4.5 | 1.52 | 3.5 |
| 60% | 1.46 | 4 | 1.41 | 4 | 1.09 | 4.75 | 1.13 | 4.5 | 1.35 | 4.75 | 1.42 | 4 |
| 55% | 1.34 | 4.25 | 1.14 | 4.5 | 0.98 | 5 | 1.01 | 4.75 | 1.15 | 5 | 1.30 | 4.25 |
| 50% | 1.18 | 4.75 | 0.96 | 4.75 | 0.89 | 5 | 0.89 | 5 | 1.03 | 5 | 1.22 | 4.5 |
| 40% | 1.01 | 5 | 0.73 | 5 | 0.76 | 5 | 0.76 | 5 | 0.80 | 5 | 1.07 | 5 |
| 30% | 0.77 | 5 | 0.51 | 5 | 0.63 | 5 | 0.62 | 5 | 0.61 | 5 | 0.86 | 5 |
| 25% | 0.57 | 5 | 0.27 | 5 | 0.50 | 5 | 0.48 | 5 | 0.41 | 5 | 0.61 | 5 |
| 20% | 0.39 | 5 | | | 0.38 | | 0.36 | 5 | | | | |

FIG. 28

| | GAP | TONER | SOLID DENSITY | SOLID AMOUNT | LINE AMOUNT | RATIO (a/b) | STACK SCATTERING RANK |
|---|---|---|---|---|---|---|---|
| EX. 5 | 0.3 | PULVERIZED | 1.31 | 0.5 | 0.63 | 1.22 | 4.5 |
| COM.EX. 5 | 0.5 | PULVERIZED | 1.29 | 0.5 | 0.79 | 1.57 | 3 |

FIG. 31

| | GAP | TONER | SOLID DENSITY | SOLID AMOUNT | LINE AMOUNT | RATIO (a/b) | STACK SCATTERING RANK | OMISSION RANK |
|---|---|---|---|---|---|---|---|---|
| EX. 6 | 0.4 | SPHERICAL | 1.31 | 0.41 | 0.58 | 1.42 | 5 | 5 |
| COM.EX. 6 | 0.4 | PULVERIZED | 1.28 | 0.49 | 0.7 | 1.43 | 3.5 | 3 |

| BELT NO. | 5-SECOND POTENTIAL [V] | IRREGULARITY | CLEANING |
|---|---|---|---|
| 22 | 212 | △ | × |
| 23 | 235 | ○ | ○ |

FIG. 34

| BELT NO. | 5-SECOND POTENTIAL [V] | T-SECOND POTENTIAL [V] | IRREGULARITY |
|---|---|---|---|
| 1 | 481 | 495 | × |
| 2 | 436 | 480 | × |
| 3 | 207 | 311 | △ |
| 4 | 134 | 198 | ○ |
| 5 | 151 | 190 | ○ |
| 6 | 11 | 16 | ○ |

INTERMEDIATE IMAGE TRANSFER DEVICE FOR A COLOR IMAGE FORMING APPARATUS

BACKGROUND OF THE INVENTION

1. Field of the Invention

The present invention relates to a copier, facsimile apparatus, printer or similar image forming apparatus and more particularly to an intermediate image transfer type of color image forming apparatus.

2. Description of the Background Art

Generally, an intermediate image transfer type of image forming apparatus includes an image carrier, an intermediate image transfer body, primary image transferring means for transferring a toner image from the image carrier to the intermediate image transfer body, and secondary image transferring means for transferring the toner image from the intermediate image transfer body to a sheet or similar recording medium. This type of image forming apparatus is disclosed in, e.g., Japanese Patent Laid-Open Publication No. 2002-214932. The image carrier, configured to carry a toner image corresponding to image data, is implemented as a photoconductive drum by way of example. For the intermediate image transfer body, use is often made of an endless, intermediate image transfer belt passed over a plurality of rollers. To effect primary image transfer, an electric field is formed between the drum and the belt. For secondary image transfer, an electric field and/or pressure is applied between the belt and a sheet.

Japanese Patent Laid-Open Publication No. 2000-010415, for example, teaches an intermediate image transfer type of color copier, color laser beam printer or similar color image forming apparatus. The apparatus taught in this document sequentially transfers toner images of different colors to an intermediate image transfer belt one above the other and then transfers the resulting composite color image to a sheet.

A problem with the intermediate image transfer type of image forming apparatus is that when image formation is repeated, image transferability is lowered or image transfer becomes irregular due to aging, as determined by experiments. One cause of the above problem is that resistivity on the surface of the belt to which a bias is applied varies due to repeated image formation. A change in the surface resistivity of the belt directly translates into a change in adequate bias and other image transfer conditions, lowering transferability or, when they locally vary, rendering image transfer irregular. More specifically, when the surface resistivity of the belt decreases due to aging, a current easily flows on the surface of the belt to which the bias is applied. If the amount of current is large, then a current expected to contribute to image transfer decreases with the result that transferability is lowered or toner scattering occurs due to an increase in electric field in a non-image transfer region.

In a tandem image forming apparatus including a plurality of image carriers, the distance between nearby primary image transferring means is small. Consequently, if the surface resistivity of the surface applied with the bias is low, then a current easily flows on the surface of the belt and causes, if large in amount, nearby primary image transferring means to interfere with each other.

In an image forming apparatus configured to apply a secondary image transfer bias to the inner or reverse surface of the belt, a current is apt to flow along the inner surface of the belt. This also causes the problems discussed above to arise.

Another cause of low transferability and irregular image transfer ascribable to aging is that the volume resistivity of the belt decreases as image formation is repeated. This also causes the image transfer conditions to vary as when the surface resistivity of the belt varies, bringing about the problems stated above.

It is known that the variation of resistance stated above occurs because the belt is subject to electric adverse influence, i.e., so-called hazard ascribable to, e.g., repeated bias application. To protect the belt from such deterioration ascribable to aging, Japanese Patent Laid-Open Publication Nos. 08-054789 and 09-281814, for example, propose to detect information dependent on the resistance of the belt and control a bias for image transferring means by taking account of the information detected.

The bias control scheme, however, cannot obviate irregular image transfer because the resistance of the belt does not uniformly vary due to the influence of toner and sheet. Further, a current flows along the surface of the belt due to the fall of resistance, so that interference between nearby image transferring means cannot be obviated. Moreover, in the case where a voltage used for primary image transfer is susceptible to the area of a toner image or the thickness of a toner layer, transferability varies between a single-color image and a composite color image with the result that image transfer is apt to become short or excessive.

In the intermediate image transfer type of image forming apparatus, irregular image transfer sometimes occurs on the surface of the belt in the event of primary and secondary image transfer, as also determined by experiments. One cause of this irregularity is that an irregular potential distribution, which is the replica of the potential of a latent image formed on the drum, sometimes appears on the belt at the time of primary image transfer. If the belt with such an irregular potential distribution enters a primary image transfer nip, then irregular image transfer occurs in accordance with the above irregular potential distribution.

More specifically, when a latent image is formed on the drum, a surface potential difference occurs between the image portion and the non-image portion or background of the drum. The surface potential difference remains on the drum even when the latent image is developed. When the drum faces a primary image transfer roller or similar primary image transferring means via the belt at the primary image transfer nip, a potential difference occurs between the image portion and the non-image portion relative to the roller. An electric field for primary image transfer is strong in the portion where the potential difference is great or weak in the other portion where it is small. A great amount of current flows in the portion where the electric field is strong, so that the surface potential of the belt becomes higher in the above portion than in the portion where the electric field is weak. If such an irregular potential distribution remains up to the next primary image transfer nip, then primary image transfer efficiency varies and brings about irregular image transfer.

Another cause of irregular image transfer is that the potential of the belt becomes irregular due to charge deposited on the belt in the event of secondary image transfer. Such irregularity is ascribable to the fact that the surface potential of the belt, remaining after the belt has moved away from the secondary image transfer nip, is different from the portion of the belt facing a sheet to the portion not facing it.

Why the potential difference occurs on the surface of the belt moved away from the secondary image transfer position will be described hereinafter. A current flows more easily in the non-facing region of the belt not facing a sheet than in the facing region of the same facing the sheet. As a result, when the secondary image transfer bias is applied from a secondary image transfer roller or similar secondary image transfer member, more current flows in the non-facing region than in the facing region. Consequently, more charge is fed to the non-facing region than to the facing region raising the surface potential of the non-facing region. It follows that the surface potential of the belt moved away from the secondary image transfer position is higher in the non-facing region than in the facing region. If such an irregular potential distribution remains on the belt up to the primary image transfer position following the secondary image transfer position, then a difference in primary image transfer efficiency occurs in accordance with the potential difference of the belt, resulting in irregular image transfer corresponding to the irregular potential distribution. Therefore, if the next toner image is transferred to the belt over the portions different in potential from each other, density becomes irregular accordingly.

Laid-Open Publication No. 2002-214932 mentioned earlier proposes to obviate irregular density ascribable to the potential contrast of the belt by reducing the contrast when the facing region and non-facing region of the belt pass the secondary image transfer nip. More specifically, for such a purpose, the above document switches the current value of the secondary image transfer bias between the time when the belt faces a sheet and the time when it does not face the sheet. Although this scheme can switch secondary bias control between the facing region and non-facing region of the belt, it cannot do so when the facing region and non-facing region exist together in the widthwise direction of the belt. It follows that irregular image transfer cannot be obviated when, e.g., a sheet of size A4 is passed in a landscape or a profile position or when a sheet of size B5 or similar relatively small size is passed.

SUMMARY OF THE INVENTION

It is a first object of the present invention to provide an image forming apparatus capable of obviating defective image transfer ascribable to the variation of the surface or the volumetric resistivity of an intermediate image transfer belt ascribable to aging.

It is a second object of the present invention to provide an image forming apparatus capable of obviating irregular image transfer apt to occur at the time of primary image transfer, which follows previous primary image transfer, due to the potential irregularity of the surface of an intermediate image transfer body, which is brought about by the previous primary image transfer due to the influence of the potential of a latent image.

It is a third object of the present invention to provide an image forming apparatus capable of more positively obviating irregular image transfer at the time of primary image transfer, which follows secondary image transfer, due to the potential irregularity of an intermediate image transfer belt ascribable to the secondary image transfer.

An intermediate image transfer type of image forming apparatus of the present invention includes an image carrier, an intermediate image transfer body, primary image transferring means for transferring a toner image from the image carrier to the intermediate image transfer body with a primary image transfer bias, and secondary image transferring means for transferring the toner image from the intermediate image transfer body to a sheet. When the surface resistivity of the intermediate image transfer body is measured by a method that repeatedly applies a voltage of 200 V for 60 seconds to the intermediate image transfer body and grounds the intermediate image transfer body for 10 seconds 1,000 consecutive times, a difference in absolute value between the logarithm of the first time of measurement and that of the thousandth time of measurement is 0.5 log Ω/□ or below.

BRIEF DESCRIPTION OF THE DRAWINGS

The above and other objects, features and advantages of the present invention will become more apparent from the following detailed description taken with the accompanying drawings in which:

FIG. 3 is a table listing five intermediate image transfer belts each having a particular amount of surface resistivity variation and image transferability ranks attainable therewith;

FIG. 5 is a table listing with another five intermediate image transfer belts each having a particular amount of surface resistivity variation and image transferability ranks attainable therewith;

FIG. 9 is a table listing the amounts of volumetric resistivity variation of another intermediate image transfer belts and transferability ranks attainable therewith;

FIG. 11 is a table listing the amounts of volumetric resistivity variation of another four intermediate image transfer belts and transferability ranks attainable therewith;

FIG. 14 is a table listing image density estimated on the 100,000th image with another intermediate image transfer belt;

FIG. 17 is a table listing irregular image transfer estimated on an image with each of six intermediate image transfer belts each having a particular surface potential attenuation ratio;

FIG. 19 is a table listing showing the presence/absence of image defect estimated on an image with another nine intermediate image transfer belts different in surface resistivity from each other;

FIG. 21 is a table showing the properties of the belts of FIG. 20;

FIG. 25 is a table showing a relation between the amount of toner deposited and stack scattering rank determined with the belts of FIG. 20;

FIG. 28 is a table comparing Example 5 of the alternative embodiment and Comparative Example 5 as to stack scattering;

FIG. 31 is a table comparing Example 6 of the alternative embodiment and Comparative Example 6 as to stack scattering;

FIG. 34 is a table showing the degrees of irregular image transfer estimated with the belts of FIG. 17.

DESCRIPTION OF THE PREFERRED EMBODIMENTS

Figure 1:
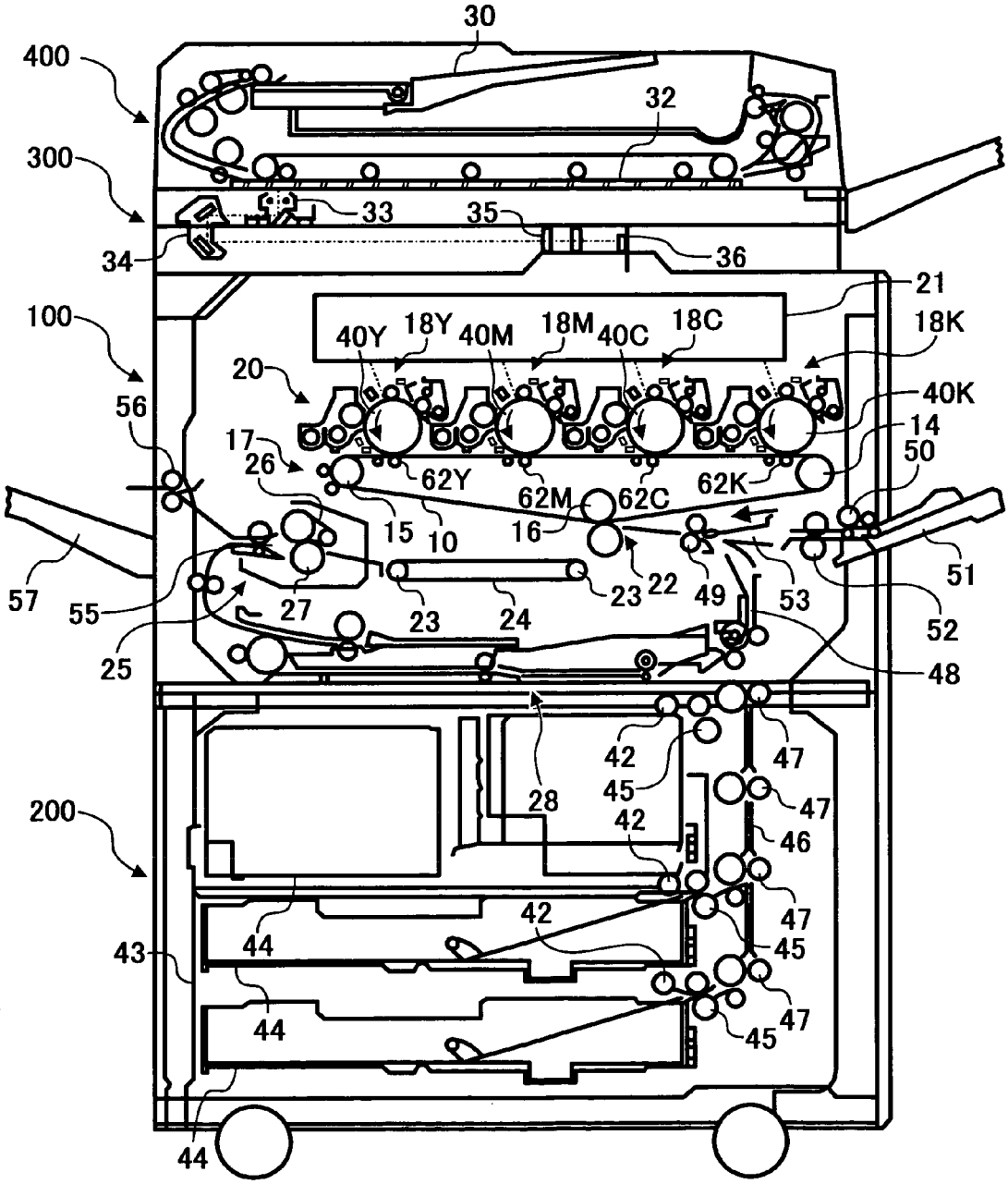
FIG. 1 is a view showing an indirect image transfer type of image forming apparatus embodying the present invention.

Referring to FIG. 1 of the drawings, a color image forming apparatus embodying the present invention and directed mainly toward the first object stated earlier is shown. As shown, the color image forming apparatus is generally made up of an electrophotographic color copier body 100, a sheet feed table 200 on which the copier body 100 is mounted, and an ADF (Automatic Document Feeder) 400 mounted on the copier body 100. In FIG. 1, suffixes Y, M, C and K stand for yellow, cyan, magenta and black, respectively.

The copier body 100 includes an endless, intermediate image transfer belt (simply belt hereinafter) 10 passed over a plurality of rollers, e.g., three rollers 14, 15 and 16 and movable clockwise as viewed in FIG. 1. A belt cleaner 17 is positioned at the left-hand side of the roller or second roller 15, as viewed in FIG. 1, and removes residual toner left on the belt 10 after image transfer.

Four image forming means 18Y, 18M, 18C and 18K are arranged side by side above the upper run of the belt 10 between the roller or first roller 14 and the second roller 15, constituting a tandem image forming section 20. An exposing unit 21 is positioned above the tandem image forming section 20.

The image forming means 18 respectively include photoconductive drums or image carriers 40Y, 40M, 40C and 40K for carrying a yellow, a cyan, a magenta and a black toner image thereon. Primary image transfer rollers or primary image transferring means 62Y, 62M, 62C and 62K are located at primary image transfer positions where they respectively face the drums 40Y, 40M, 40C and 40K with the intermediary of the belt 10.

The roller 14 is implemented as a drive roller for causing the belt 10 to turn. In a monochrome or black mode, the rollers 15 and 16 other than the drive roller 14 are moved to release the drums 40Y, 40M and 40C from the belt 10.

As for an image forming apparatus of the type including only one photoconductive drum, it is a common practice to form a black image first in order to increase first-copy speed. In this case, only when a document is a color document, color images are formed after a black image.

A secondary image transferring device 22 is positioned at the opposite side to the image forming section 20 with respect to the belt 10. In the illustrative embodiment, the secondary image transferring device 22 comprises an endless, secondary image transfer belt (simply belt hereinafter) 24 passed over two rollers 23. The secondary image transferring device 22 is pressed against the roller or third roller 16 via the belt 10 at the time when an image is to be transferred from the belt 10 to a sheet or recording medium.

A fixing unit 25 is positioned beside the secondary image transferring device 22 for fixing the image transferred to the sheet. The fixing unit 25 includes a press roller 27 pressed against an endless fixing belt 26.

The secondary image transferring device 22 additionally serves to convey the sheet carrying the image thereto to the fixing unit 25. While the secondary image transferring device 22 may, of course, be implemented by an image transfer roller or a non-contact charger, some device is necessary for providing such a substitute with a sheet conveying function.

In the illustrative embodiment, a sheet turning device 28 is arranged below the secondary image transferring device 22 and fixing unit 25 in parallel to the image forming section 20. In a duplex copy mode for forming images on both sides of a sheet, the sheet turning device 28 is operated to turn the sheet.

The operation of the illustrative embodiment will be described hereinafter. The operator of the copier stacks desired documents on a document tray 30 included in the ADF 400 or opens the ADF 400 away from the copier body 100, lays a desired document on a glass platen 32 included in a scanner 300, and again closes the ADF 400. Subsequently, when the operator presses a start switch not shown, the scanner 300 is driven, when documents are stacked on the ADF 400, after one document has been conveyed to the glass platen 32 or immediately driven when a document is set on the glass platen 32, causing a first and a second carriage 33 and 34 to start running. A light source mounted on the first carriage 33 illuminates the document while the resulting imagewise reflection is incident to a mirror mounted on the second carriage 34. The light incident to the mirror is reflected toward an image sensor 36 via a lens 35.

When the start switch is pressed, a drive motor, not shown, causes the drive roller 14 to rotate and turn the belt 10. At the same time, the image forming means 18 respectively form a yellow, a cyan, a magenta and a black toner image on the drums 40, which are in rotation. The toner images of different colors are sequentially transferred from the drums 40 to the belt 10 one above the other by the primary image transfer rollers 62Y through 62K, completing a composite color image on the belt 10.

Further, when the start switch is pressed, one of pickup rollers 42 disposed in the sheet feed table 200 is rotated to pay out a sheet from associated one of sheet cassettes 44, which are positioned one above the other in a paper bank 43. At this instant, a reverse roller 45 associated with the pickup roller 42 separates the above sheet from the other sheets underlying it. The sheet thus paid out is conveyed by roller pairs 47 via a sheet path 46 and then introduced into a sheet path 48 arranged in the copier body 100. The sheet is then stopped by the nip of a registration roller pair 49.

On the other hand, when the operator stacks special sheets on a manual feed tray 51, a pickup roller 50 is rotated to pay out the sheets one by one while a reverse roller 52 separates the sheet being paid out from underlying sheets. This sheet is conveyed via a sheet path 53 until it has been stopped by the nip of the registration roller pair 49.

Subsequently, the registration roller pair 49 is rotated to start conveying the sheet to a position between the belt 10 and the secondary image transferring device 22 such that the leading edge of the sheet meets the leading edge of the composite color image present on the belt 10. The secondary image transferring device 22 transfers the composite color image from the belt 10 to the sheet.

The sheet, conveyed to the fixing unit 25 by the secondary image transferring device 22, has the color image fixed thereon by heat and pressure. A path selector 55 steers the sheet coming out of the fixing unit 25 toward either one of an outlet roller pair 56 or the sheet turning device 28. The outlet roller pair 56 drives the sheet out of the copier body 100 and stacks it on a copy tray 57. The sheet turning device 28 turns the sheet and again conveys it toward the secondary image transfer position; the sheet, carrying composite color images on both surfaces, is driven out to the copy tray 57 by the outlet roller pair 56.

After the image transfer, the belt cleaner 17 removes toner left on the belt 10 to thereby prepare it for the next image formation.

While the registration roller pair 49 is, in many cases, grounded, a bias may be applied to the registration roller pair 49 in order to remove paper dust, in which case the registration roller pair 49 will be formed of conductive rubber. Each rubber roller is provided with a diameter of 18 mm and formed with a 1 mm thick, conductive NBR (nitril rubber) rubber layer on the surface thereof. Electric resistance is selected to be about $10^9$ Ω·cm in terms of the volumetric resistivity of rubber. A voltage of about −800 V is applied to one surface of a sheet to which toner is to be transferred, i.e., a front surface while a voltage of about +200 V is applied to the other surface or reverse surface of the sheet. The registration roller pair 49 may, of course, be grounded because the intermediate image transfer system causes a minimum of paper dust to reach the drums 40. The above DC bias may be replaced with an AC bias including a DC offset component.

The front surface of the sheet moved away from the registration roller pair 49, which is biased as stated above, has been slightly charged to the negative side. Therefore, in the event of image transfer from the belt 10 to the sheet, image transfer conditions different from those to be selected when a bias is not applied to the registration roller pair 49 may sometimes be required.

Now, it is likely with the intermediate image transfer type of copier described above that transferability is lowered or irregular image transfer occurs due to repeated image formation, as stated earlier. This is ascribable to the fact that the resistivity of the surface of the belt 10 to which a bias is applied varies due to aging and the fact that the volumetric resistivity of the belt 10 varies due to aging. The illustrative embodiment is capable of obviating defective image transfer ascribable to the above causes. Specific examples of the illustrative embodiment will be described hereinafter.

EXAMPLE 1

Ten different kinds of belts 10 were prepared. To measure the variation of each belt ascribable to aging, the surface resistivity of the belt is measured by repeating the application of a voltage and grounding 1,000 times under preselected conditions. A value produced by subtracting the logarithm of the result of the first measurement from the logarithm of the result of the thousandth measurement (log Ω/□) will be referred to as a variation of resistance hereinafter. In this case, a logarithm is a common logarithm.

The variation of resistance increased in five belts in the range of 0.01 log Ω/□ to 0.55 log Ω/□; such five belts were labeled Nos. 1 through 5 in the incrementing order of absolute value. Likewise, the variation of resistance decreased in the other five belts in the range of 0.1 Ω/□ to 0.56 Ω/□; such five belts were labeled Nos. 6 through 10 in incrementing order of absolute value.

Figure 2:
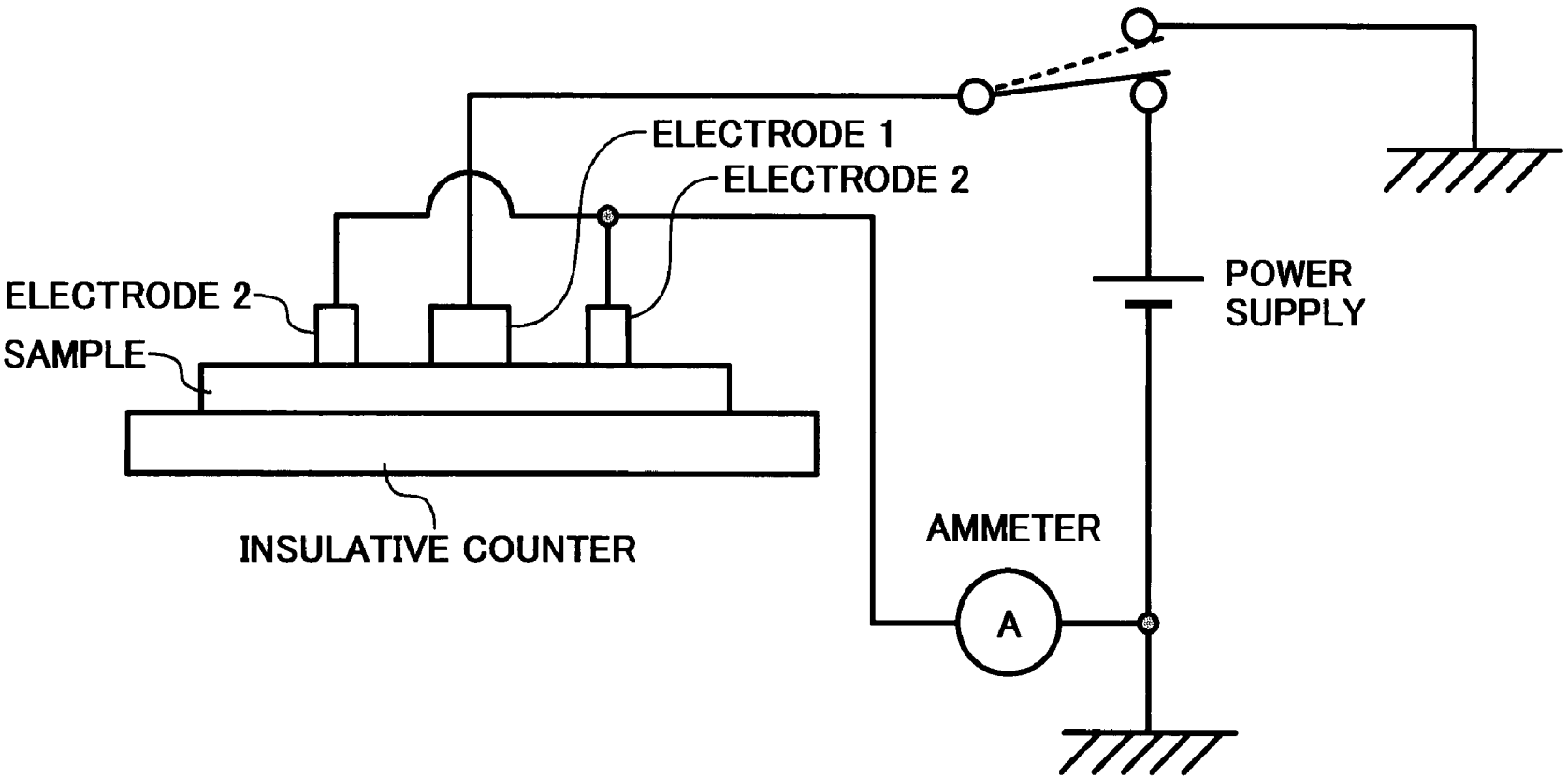
FIG. 2 shows a device for measuring surface resistivity by applying a voltage.

FIG. 2 shows a device used to measure the surface resistivity of each belt. As shown, while a probe is pressed against one surface of a belt or sample, a preselected voltage of v1 V is applied via an electrode 1. In this condition, a current flowing through an electrode 2 is measured by an ammeter. For the measurement, use was made of a high resistivity meter HYRESTER-UP (MCP-AT450) (trade name) and a probe USR (MCP-ATP14) both of which are available from MITSUBISHI CHEMICAL.

With the resistivity meter mentioned above, it is possible to freely set a voltage application time t1 (sec) and to apply a voltage and then ground the electrode 1 for thereby discharging the belt. Further, it is possible to automatically apply the voltage on the elapse of a discharge time t2 (sec), which is also freely selectable. In addition, the voltage can be repeatedly applied any desired number of times N1. The voltage is repeatedly applied on the assumption of electric hazard particular to the belt 10 in the actual electrophotographic apparatus. Assume that the voltage is continuously applied and that the belt 10 has a laminate structure. Then, charge accumulates at the interface between nearby layers and obstructs the flow of a current as the time elapses. Therefore, continuously applying the voltage is not efficient in view of the above objective.

There were also used a high-tension power supply COR-A-TROL (610C) (trade name) available from Trec and an ammeter Digital Electrometer TR8652 available from Advantest.

Experimental results representative of a relation between the variation of surface resistivity and transferability will be described hereinafter. FIG. 3 shows transferability ranks in numerical values determined with the electrophotographic apparatus shown in FIG. 1. Transferability was estimated on the 100,000th image produced by continuing image formation with each of the belts Nos. 1 through 5 whose variations of surface resistivity tended to increase although to different degrees.

Figure 4:
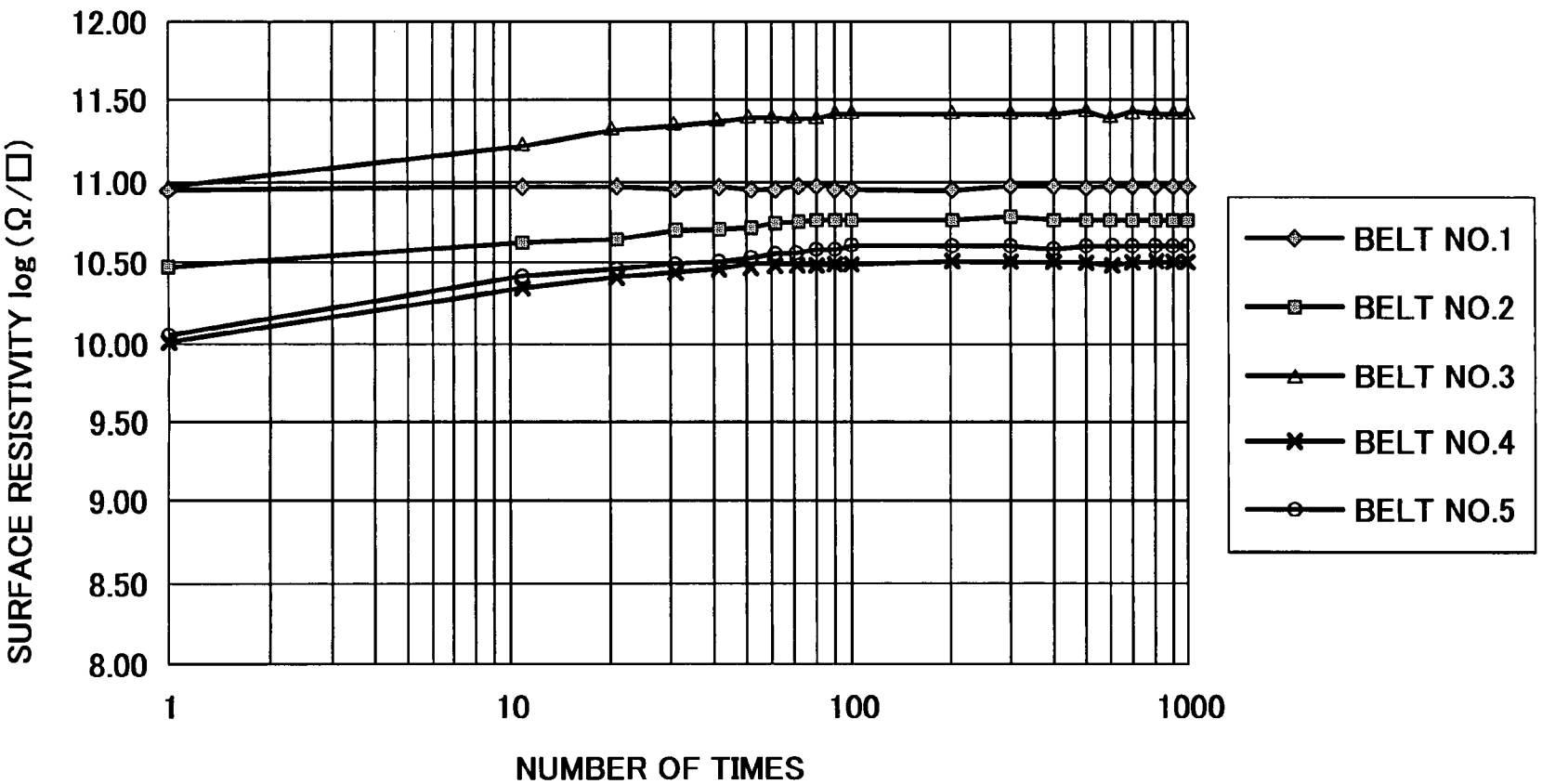
FIG. 4 is a graph showing the results of measurement conducted with the device of FIG. 2.

FIG. 4 is a graph showing the results of measurement conducted with the device described with reference to FIG. 2. Preselected conditions 1 included the voltage v1 of 200 V, the voltage application time t1 of 60 seconds, the discharge time t2 of 10 seconds, and the number of times of repetition N1 of 1,000. Transferability was estimated in five ranks 1 through 5. Transferability rank 5 was acceptable in image quality while transferability rank 4 was the allowable lower limit as to image quality.

As FIG. 3 indicates, the belts Nos. 1 through 4 with the variations of resistance up to 0.50 were above the lower limit, but the belt No. 5 with the variation of 0.55 brought about irregular image transfer and lowered image density to an unacceptable degree. It will therefore be seen that with the belt whose variation of resistance is 0.5 log □/Ω or below, it is possible to confine transferability and image density in an allowable range.

Figure 6:
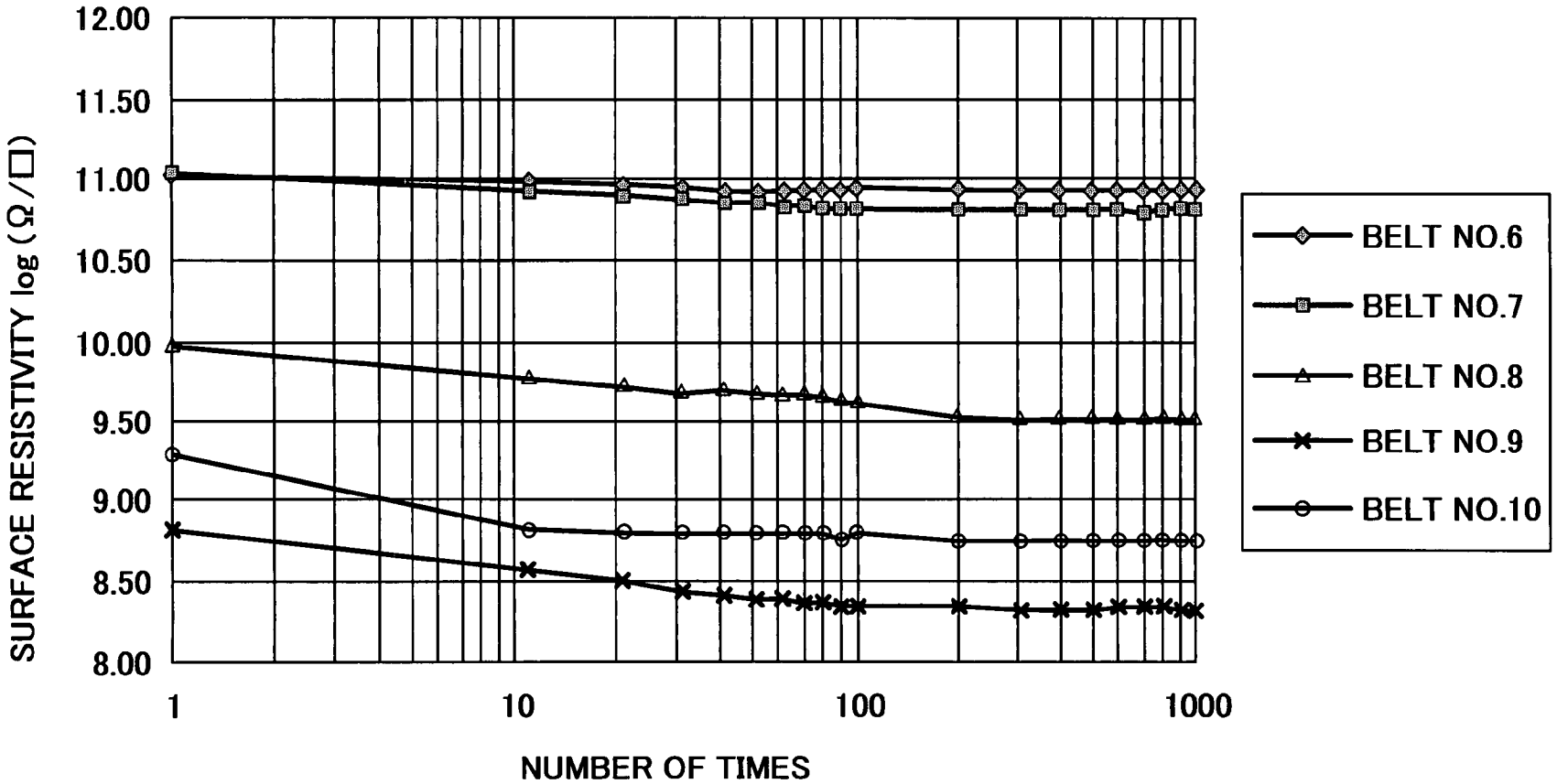
FIG. 6 is a graph showing the results of measurement also conducted with the device of FIG. 2.

FIG. 5 shows transferability ranks in numerical values also determined with the electrophotographic apparatus shown in FIG. 1. Transferability was estimated on the 100,000th image produced by continuing image formation with each of the belts Nos. 6 through 10 whose variations of surface resistivity tended to decrease although to different degrees. It is to be noted that the variation of resistance is represented by an absolute value. FIG. 6 is a graph showing the results of measurement conducted with the arrangement described with reference to FIG. 2.

As FIG. 5 indicates, the belts Nos. 6 through 9 with the variations of resistance up to 0.49 were above the lower limit, but the belt No. 10 with the variation of 0.56 brought about irregular image transfer and lowered image density to an unacceptable degree. It will therefore be seen that with the belt whose variation of resistance is 0.49 log □/Ω or below, it is possible to confine transferability and image density in an allowable range.

Although FIGS. 4 and 6 are opposite in the sign of resistance variation, FIGS. 3 and 5, showing absolute values, are extremely close in tendency to each other.

Figure 7:
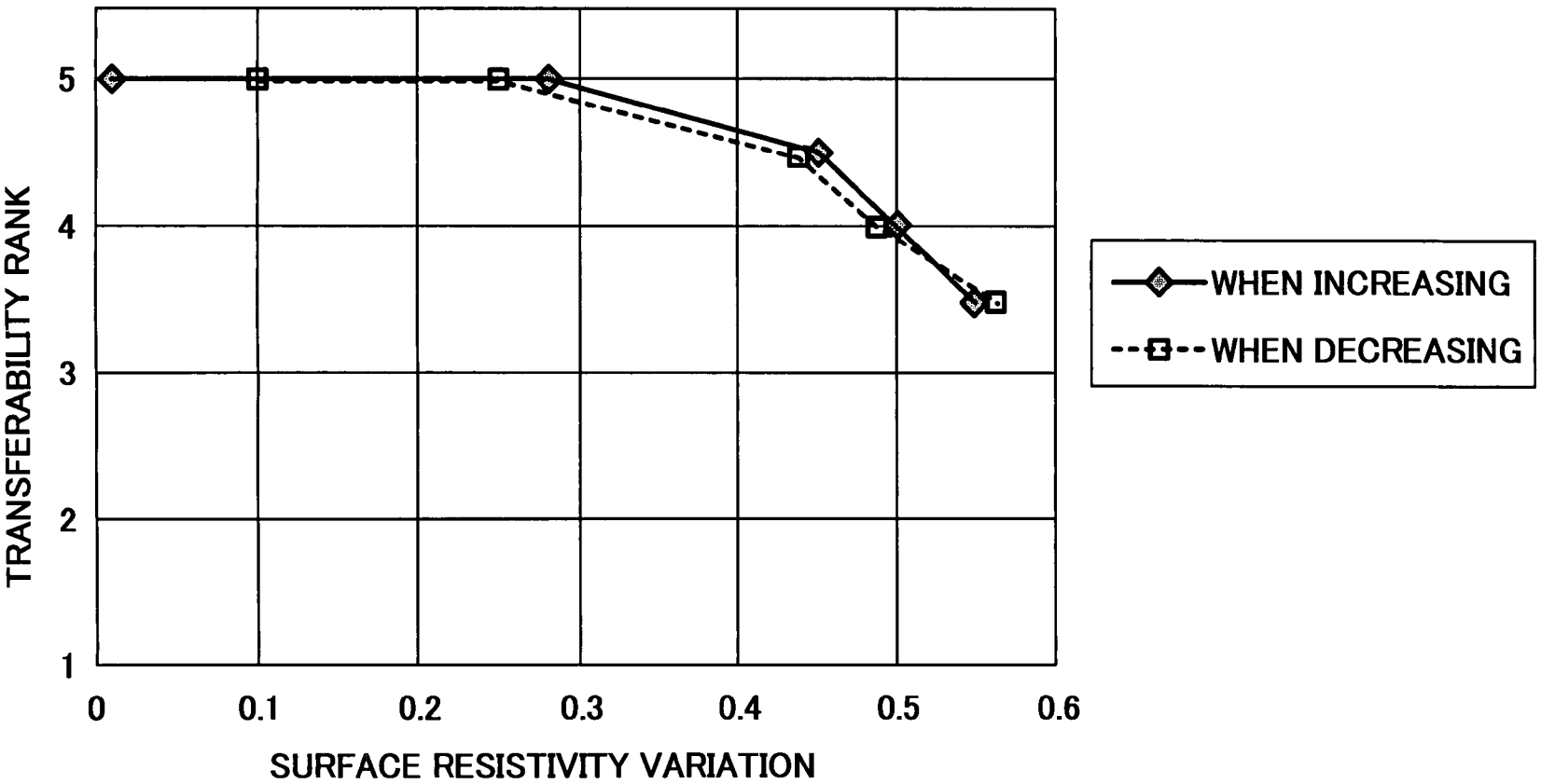
FIG. 7 is a graph collectively showing the data of FIGS. 3 and 5.

FIG. 7 is a graph collectively showing the data of FIGS. 3 and 5. As shown, two curves differ from each other only by the degree of an error. It follows that whether the variation of surface resistivity ascribable to aging tends to increase or decrease, a transferability rank of substantially 4 or above is achievable if the absolute value of the difference in logarithm is 0.5 or below, insuring image quality above the allowable limit. In this connection, when the absolute value of the difference in logarithm is 0.5, the ratio in resistance between the first and thousandth times of measurement is about 3.16.

In the tandem electrophotographic copier of the illustrative embodiment configured to transfer toner images of different colors to the belt 10 during a single pass of the belt 10, the distance between nearby primary image transfer nips is apt to be small. In this condition, if the surface resistivity of the inner surface of the belt 10 is low, then a current is apt to flow on the surface of the belt 10. If the amount of such a current is large, then interference is likely to occur between nearby primary image transfer positions and cause the bias for image transfer to fluctuate, resulting in irregular image transfer and other defects. Example 1 described above is therefore advantageous when applied to this type of copier.

EXAMPLE 2

Example 2 to be described hereinafter is identical with Example 1 as to the configuration of the electrophotographic copier, so that the following description will concentrate on a difference between Examples 1 and 2. In Example 2, a bias opposite in polarity to toner was applied to the roller 16, so that toner is transferred from the belt 10 to a sheet by electrostatic repulsion. When a bias is so applied to the inner or reverse surface of the belt 10 and if the surface resistivity of the inner surface is low, then a current easily flows along the inner surface. If the amount of such a current is large, then a current to contribute to image transfer decreases with the result that transferability is lowered or an electric field in a non-transfer region is intensified to bring about toner scattering.

Example 2 is therefore advantageous when applied to the electrophotographic copier in which various problems arise when surface resistivity varies on the inner surface of the belt 10. Further, because Example 2 does not apply a bias for secondary image transfer to the belt 10 via a sheet, there can be reduced the influence of resistance of a sheet on transferability.

EXAMPLE 3

Ten different kinds of belts 10 were prepared. To measure the variation of each belt ascribable to aging, the volumetric resistivity of the belt is measured by repeating the application of a voltage and grounding a thousand times under preselected conditions. A value produced by subtracting the logarithm of the result of the first measurement from the logarithm of the result of the thousandth measurement (log (Ω/□) will be referred to as a variation of volumetric resistivity hereinafter. In this case, a logarithm is a common logarithm.

The variation of volumetric resistivity increased in five belts in the range of 0.74 log Ω.cm to 2.80 log Ω.cm; such five belts were labeled Nos. 11 through 15 in the incrementing order of absolute value. Likewise, the variation of volumetric resistivity decreased in four belts in the range of 0.11 Ω.cm to 2.53 Ω.cm; such five belts were labeled Nos. 16 through 19 in incrementing order of absolute value.

Figure 8:
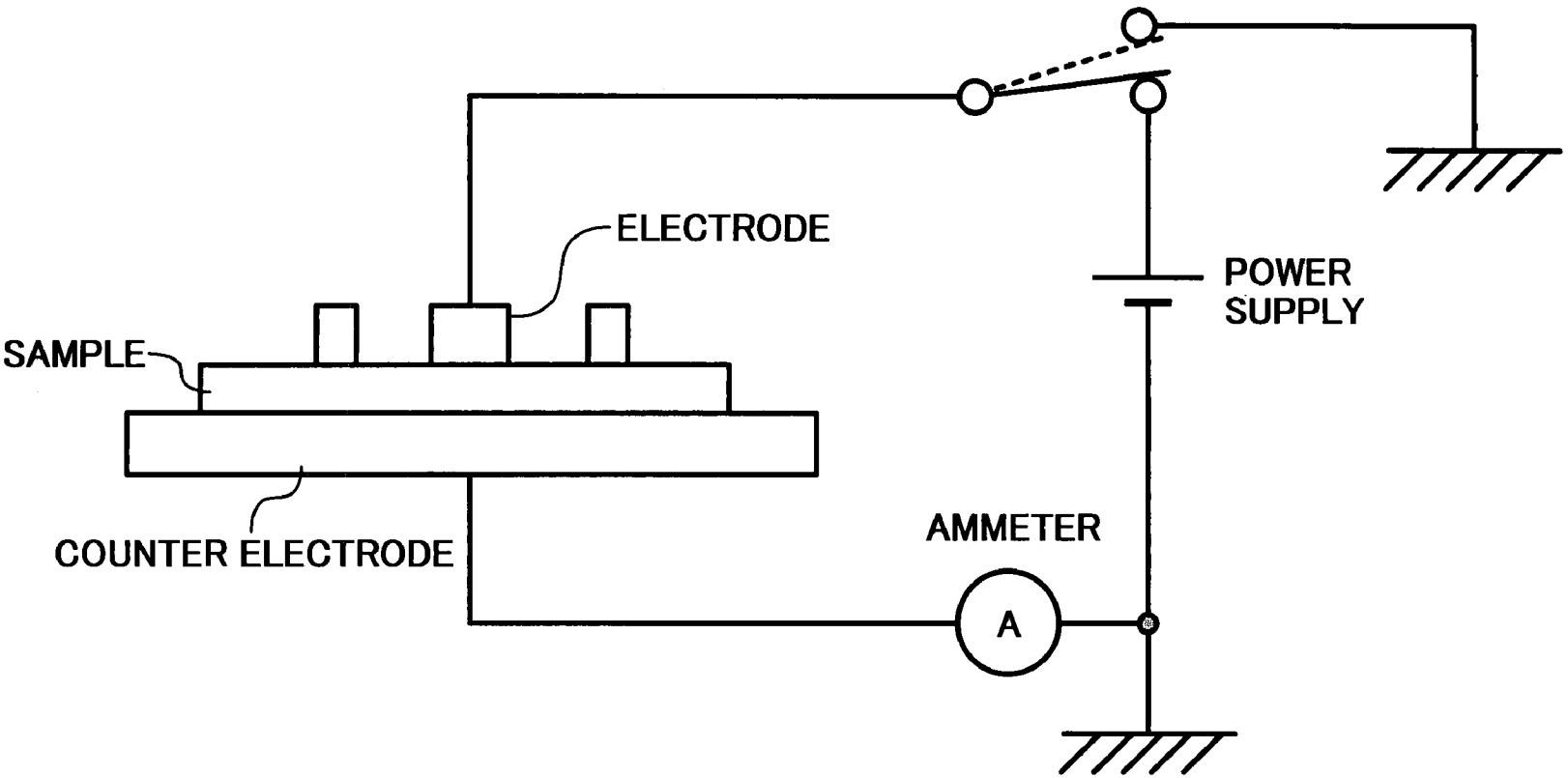
FIG. 8 shows a device for measuring volumetric resistivity by applying a voltage.

FIG. 8 shows a device used to measure the volumetric resistivity of each belt. As shown, while a probe is pressed against one surface of a belt or sample, a preselected voltage of v2 V is applied via an electrode. In this condition, a current flowing through a counter electrode is measured by an ammeter. For the measurement, use was made of the same high resistance meter and probe as in Example 1. With HYRESTER mentioned earlier, it is possible to freely set a voltage application time t3 (sec) and to apply a voltage and then ground the electrode 1 for thereby discharging the belt. Further, it is possible to automatically apply the voltage on the elapse of a discharge time t4 (sec), which is also freely selectable. In addition, the voltage can be repeatedly applied any desired number of times N2. There were also used a high-tension power supply COR-A-TROL (610C) and an ammeter Digital Electrometer TR8652 mentioned earlier.

Experimental results representative of a relation between the variation of volumetric resistivity and transferability will be described hereinafter. FIG. 9 shows transferability ranks in numerical values determined with the electrophotographic apparatus shown in FIG. 1. Transferability was estimated on the 100,000th image produced by continuing image formation with each of the belts Nos. 11 through 15 whose variations of volumetric resistivity tended to increase although to different degrees.

Figure 10:
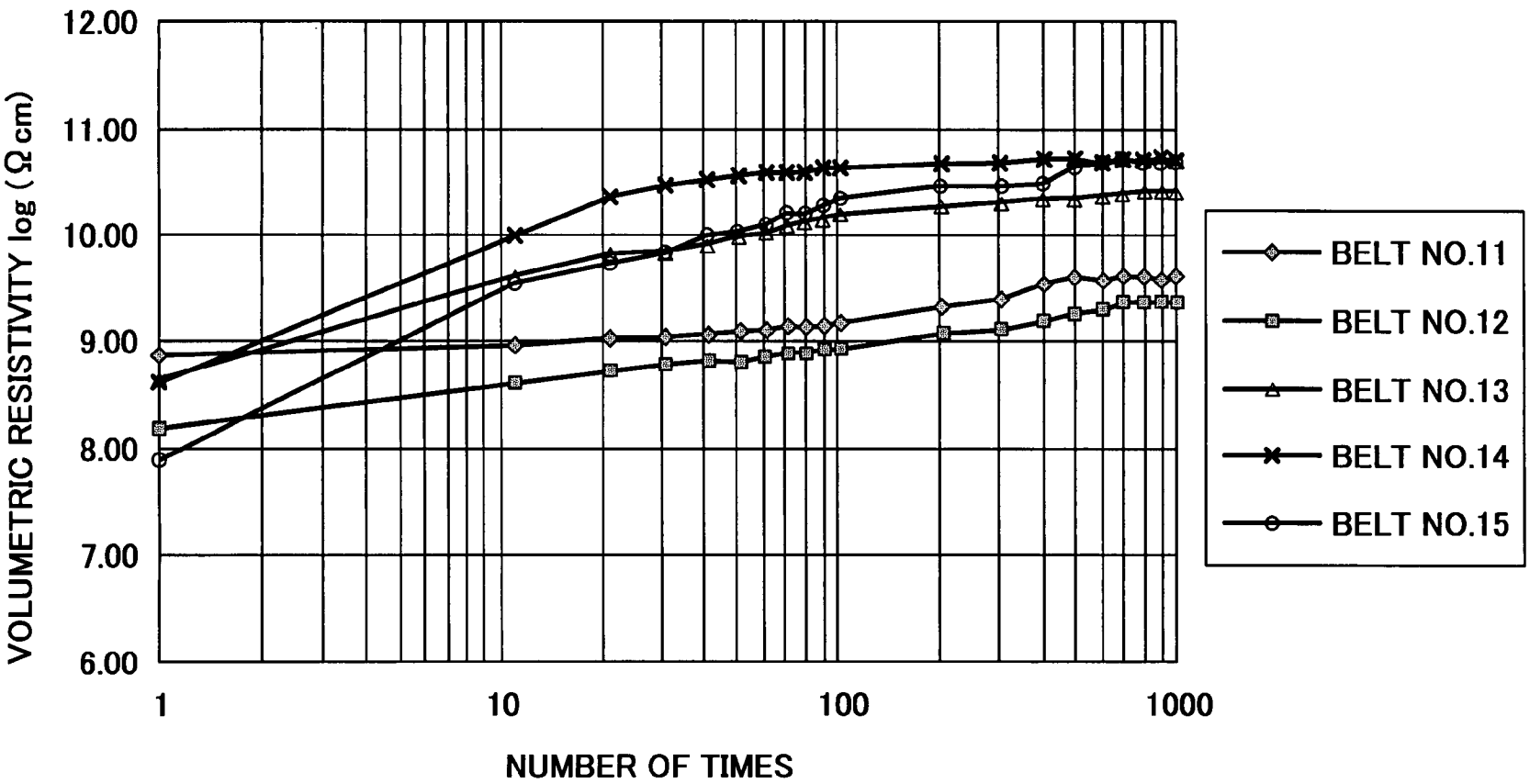
FIG. 10 is a graph showing the results of measurement conducted with the device of FIG. 8.

FIG. 10 is a graph showing the results of measurement conducted with the device described with reference to FIG. 8. Preselected conditions 2 included the voltage v2 of 50 V, the voltage application time t3 of 60 seconds, the discharge time t4 of 10 seconds, and the number of times of repetition N1 of 1,000. Transferability was estimated in five ranks 1 through 5. Transferability was estimated with the same principle as in Example 1.

As FIG. 9 indicates, the belts Nos. 11 through 14 with the variations of volumetric resistivity of up to 2.11 were above the acceptable lower limit, but the belt No. 15 with the variation of 2.80 brought about irregular image transfer and lowered image density to an unacceptable degree. It will therefore be seen that with the belt whose variation of volumetric resistivity is 2.11 log Ω.cm or below, it is possible to confine transferability and image density in an allowable range.

Figure 12:
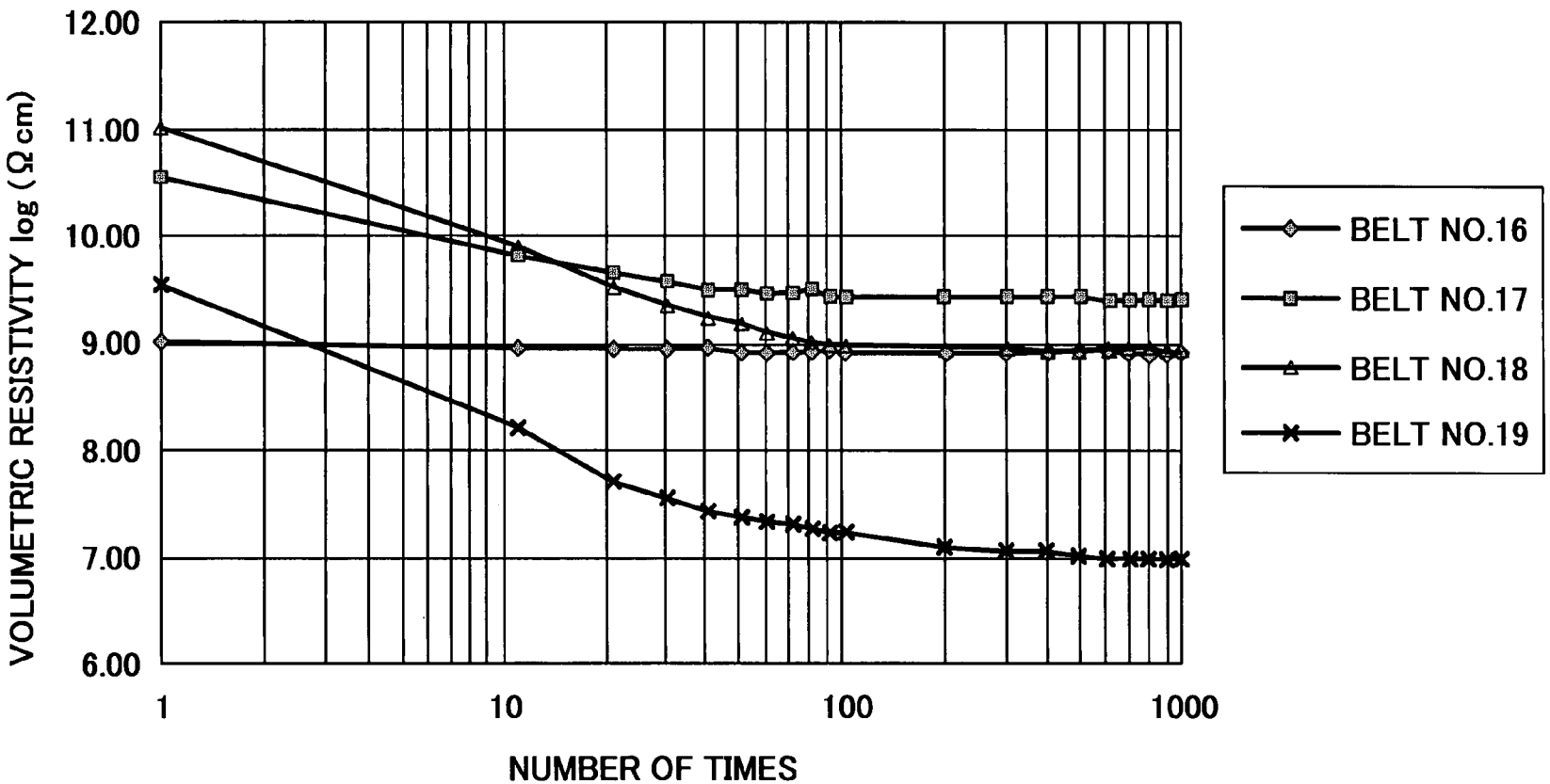
FIG. 12 is a graph showing the results of measurement effected with the device of FIG. 8

FIG. 11 shows transferability ranks in numerical values also determined with the electrophotographic apparatus shown in FIG. 1. Transferability was estimated on the $100{,}000^{th}$ image produced by continuing image formation with each of the belts Nos. 16 through 19 whose variations of volumetric resistivity tended to decrease although to different degrees. It is to be noted that the variation of volumetric resistivity is represented by an absolute value. FIG. 12 is a graph showing the results of measurement conducted with the device described with reference to FIG. 8.

As FIG. 12 indicates, the belts Nos. 15 through 18 with the variations of volumetric resistivity of up to 2.08 were above the lower limit, but the belt No. 19 with the variation of 2.53 brought about irregular image transfer and lowered image density to an unacceptable degree. It will therefore be seen that with the belt whose variation of volumetric resistivity is 2.08 log Ω/□ or below, it is possible to confine transferability and image density in an allowable range.

Although FIGS. 10 and 12 are opposite in the sign of resistance variation, FIGS. 9 and 11, showing absolute values, are extremely close in tendency to each other.

Figure 13:
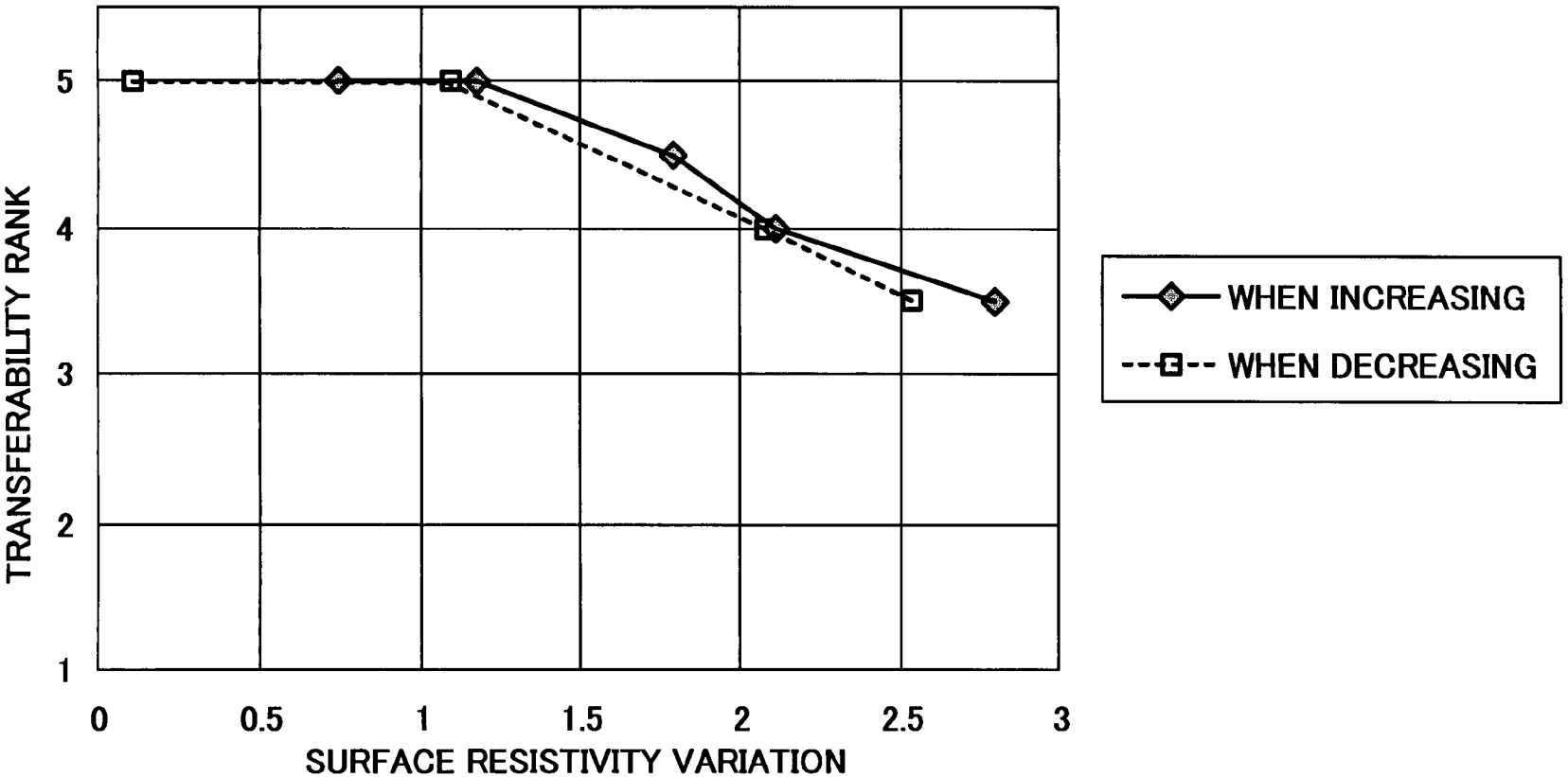
FIG. 13 is a graph collectively showing the data of FIGS. 9 and 11.

FIG. 13 is a graph collectively showing the data of FIGS. 9 and 11. As shown, two curves are extremely close to each other and are almost coincident with each other around transferability rank 4, which is the lower limit. It follows that considering some error, whether the variation of volumetric resistivity ascribable to aging tends to increase or decrease, a transferability rank substantially above 4 is achievable if the absolute value of the difference in logarithm is 2.1 or below, insuring image quality above the allowable limit. In this connection, when the absolute value of the difference in logarithm is 2.1, the ratio in volumetric resistivity between the first and thousandth times of measurement is about 125.9.

It will therefore be seen that with the belt 10 whose variation of volumetric resistivity, as measured by the arrangement of FIG. 8, is 2.1 log Ω.cm or below, it is possible to prevent the volumetric resistivity from varying to such a degree that image density decreases, thereby obviating irregular image transfer and a decrease in image density.

In Example 1 stated earlier, an acceptable image was achieved when the belt 10 had a variation of surface resistivity of 0.5 log Ω.cm or below, FIGS. 3 and 5. By contrast, in Example 3, an acceptable image was attained when the belt 10 had a variation of volumetric resistivity of 2.1 log Ω.cm or below. This difference indicates that volumetric resistance contributes to transferability less than surface resistivity. Therefore, to implement high transferability, the variation of volumetric resistance should only be 2.1 log Ω.cm or below in terms of a difference in logarithm; further reducing the variation would simply increase cost.

EXAMPLE 4

Example 4 used voltage control means for constant-voltage controlling primary bias applying means to thereby apply a constant voltage to each primary image transfer roller. In the case where a voltage for primary image transfer is susceptible to the area of a toner image or the thickness of a toner layer, transferability differs from a large image area to a small image area or from a monochromatic image to a composite color image, sometimes rendering image transfer short or excessive. Besides, even when the resistance of the belt 10 varies due to aging, if the bias for image transfer is subject to constant-current control, the image transfer voltage is apt to be short when resistance is high or excessive when it is low, causing transferability to vary or making image transfer irregular.

Example 4 is therefore advantageous when applied to the electrophotographic apparatus in which transferability is apt to vary due to the variation of the surface resistivity or the volumetric resistivity of the belt 10. Further, constant-voltage control unique to Example 4 prevents transferability from varying in accordance with the area of a toner image or the thickness of a toner layer and therefore obviates short or excessive image transfer.

FIG. 14 shows image density ranks also determined with the electrophotographic apparatus shown in FIG. 1. Image density was estimated on the 100,000th image produced by continuing image formation with a belt No. 20 whose variation of surface resistivity was 0.01 log Ω/□ in terms of logarithm. Surface resistivity was measured by the device of FIG. 2; the voltage v1 was 200 V, the application time t1 was 60 seconds, the discharge time t2 was 10 seconds, and the number of times of repetition was 1,000. Likewise, the variation of volumetric resistivity determined by the arrangement of FIG. 8 was 0.74 log Ω.cm in terms of logarithm: the voltage v2 was 50 V, the application time t3 was 60 seconds, the discharge time t4 was 10 seconds, and the number of times of repetition N2 was 1,000. Image density was estimated on the basis of three ranks, i.e., "high (○)", "acceptable (Δ)" and "low (x)".

As FIG. 14 indicates, constant-current control for the primary image transfer bias failed to implement acceptable image density when the image area ratio was 5%. By contrast, constant-voltage control realized sufficient image density when the image area ratio was 5% and when it was 95%. It follows that constant-voltage control is successful to reduce a difference in transferability and obviate a decrease in image density even when the image area ratio is different.

Hereinafter will be described the belt No. 12 as an example of the belt 10 used for measurement. Carbon black was dispersed I a polyamic acid solution. The resulting dispersion was caused to flow on a metal drum, dried, peeled off in the form of a film, and then extended at high temperature to form a polyimide film. The polyimide film was cut in a suitable size to thereby produce a seamless belt formed of polyimide resin. Generally, to form a film, after a polymer solution with carbon black dispersed therein has been introduced into a hollow cylindrical mold, the mold is rotated while being heated at 100° C. to 200° C. to thereby form a film by centrifugal molding. The film thus formed is removed form the mold in a half-set condition, put on an iron core, and then subject to polymide reaction at 300° C. to 450° C. and fully set thereby.

The belt produced by the above procedure had surface resistivity of $8.9\times10^{10}$ Ω/□ and volumetric resistivity of $1.5\times10^{8}$ Ω.cm. The volumetric resistivity of the belt varied by 1.18, as measured in the manner described previously.

Figure 15:
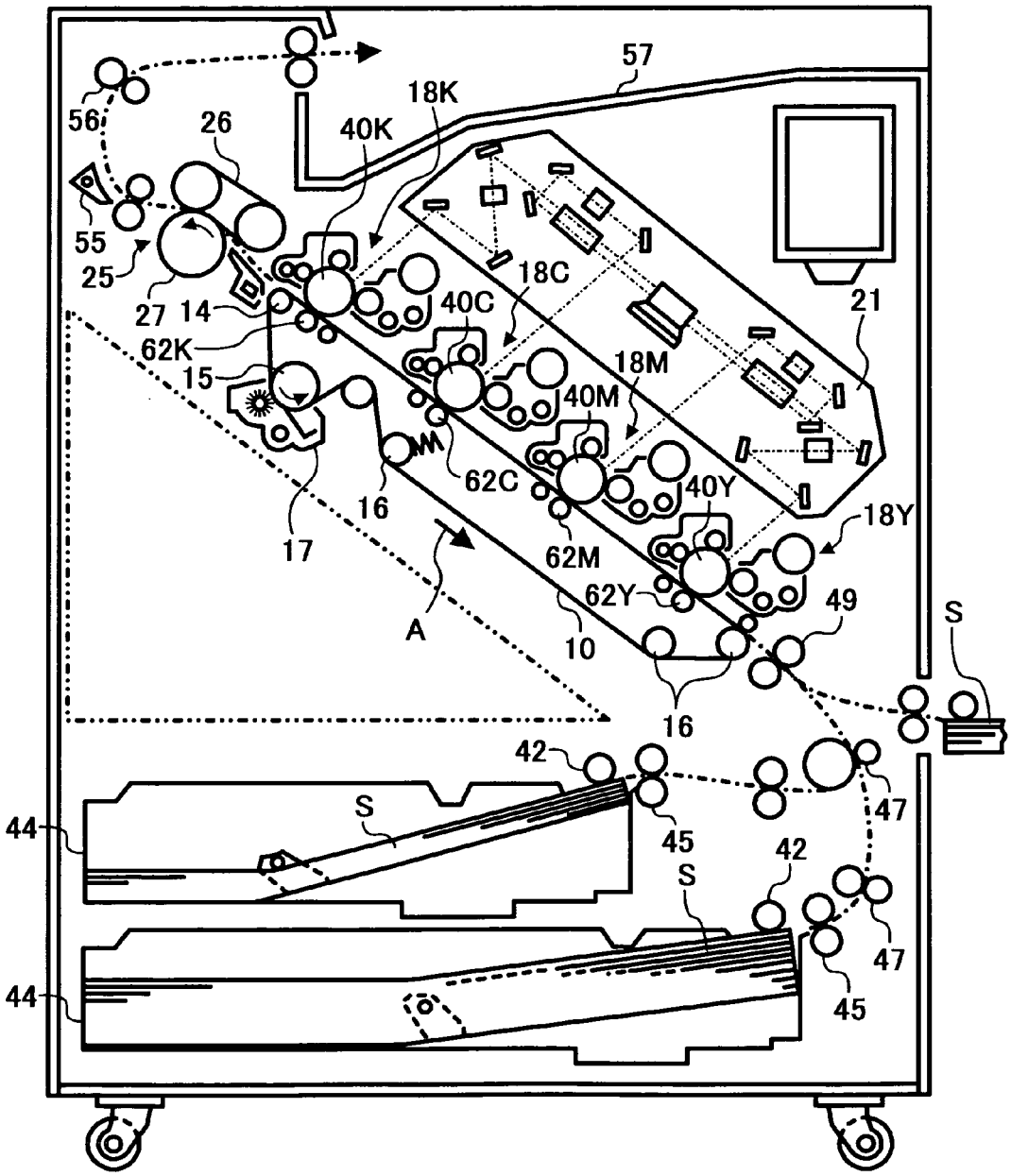
FIG. 15 shows a direct image transfer type of image forming apparatus to which the illustrative embodiment is applicable.

While the illustrative embodiment is implemented as an indirect image transfer type of image forming apparatus shown in FIG. 1, it is similarly applicable to a direct mage transfer type of image forming apparatus. FIG. 15 shows a specific configuration of the direct image transfer type of image forming apparatus. As shown, a sheet S is conveyed by a registration roller pair 49 in synchronism with image formation effected with drums 40. While a belt conveyor 10' is conveying the sheet S, toner images of different colors are sequentially transferred from the drums 40 to the sheet S one above the other at consecutive image transfer stations 62. As for the rest of the configuration and operation, the image forming apparatus of this type is similar to the indirect image transfer type of image forming apparatus.

In FIG. 15, image transfer to the sheet S is effected in substantially same conditions as the secondary image transfer of the indirect image transfer type of image forming apparatus. Therefore, by applying the illustrative embodiment to the apparatus of FIG. 15, it is also possible to achieve the various advantages described above.

As stated above, the illustrative embodiment obviates defective images by using an intermediate image transfer body whose surface resistivity on the inner surface varies little, and obviates defective images ascribable to aging by using an intermediate image transfer body whose volume resistivity varies little.

An alternative embodiment of the present invention, which is directed mainly toward the second and third objects stated earlier, will be described hereinafter. The alternative embodiment to be described is also practicable with the electrophotographic color copier shown in FIG. 1. The following description will therefore concentrate on configurations unique to the alternative embodiment.

The problem with the intermediate image transfer type of electrophotographic copier is that irregular image transfer sometimes occurs on the belt 10 at the time of primary and secondary image transfer, as stated previously. More specifically, irregular image transfer occurs due to an irregular potential distribution, which is a replica of the potential distribution of a latent image on the drum 40 and appears on the belt 10 at the time of primary image transfer. Further, the above irregular potential distribution on the belt 10 remains thereon until the belt 10 again reaches the primary image transfer position after moving via the primary image transfer nip of the last color and secondary image transfer nip. The irregular potential distribution on the belt 10, which has moved away from the primary image transfer nip of the last color, sometimes accumulates at two or more of the consecutive primary image transfer positions. The illustrative embodiment is capable of obviating irregular image transfer ascribable to the above causes. Specific examples of the illustrative embodiment will be described hereinafter.

EXAMPLE 1

The belt 10 was implemented as a belt whose surface potential, as measured at a position to which a primary image transfer bias $V_0$ was applied, decreased to $V_0/2$ or below in 5 seconds since the application of the bias. More specifically, a surface potential attenuation ratio, i.e., the ratio of charge remaining on the belt 10 in 5 seconds to the original charge was ½ or less. Let such residual charge left on the belt 10 in 5 seconds be referred to as a 5-second potential hereinafter.

Figure 16:
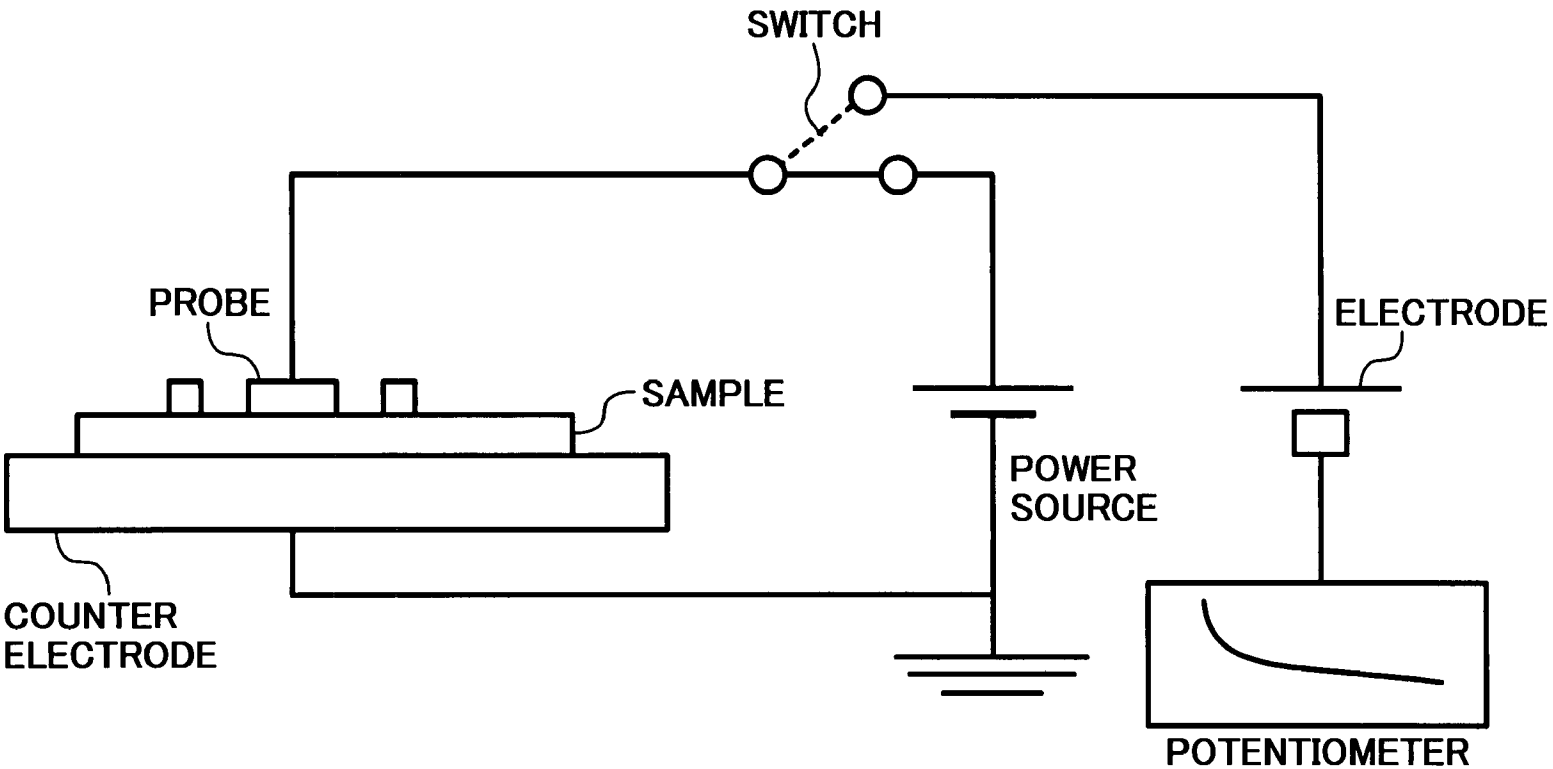
FIG. 16 shows an attenuation characteristic measuring device used to measure the surface potential attenuation ratio of an intermediate image transfer belt representative of an alternative embodiment of the present invention.

FIG. 16 shows a device used to measure the surface potential attenuation ratio of the belt 10. As shown, a probe is pressed against one surface of a belt or sample while a counter electrode, which is grounded, is held in contact with the other surface of the belt. For measurement, HYRESTER and URS mentioned earlier were used. A voltage of 100 V output from a high-tension power supply was applied via a switch at preselected timing. Subsequently, the switch is brought into connection with a surface potentiometer to thereby measure the surface potential of the belt 10 in a non-contact condition. The high-tension power supply and surface potentiometer were respectively implemented by COR-A-TROL mentioned earlier and MODEL 344 also available from Trec.

Figure 18:
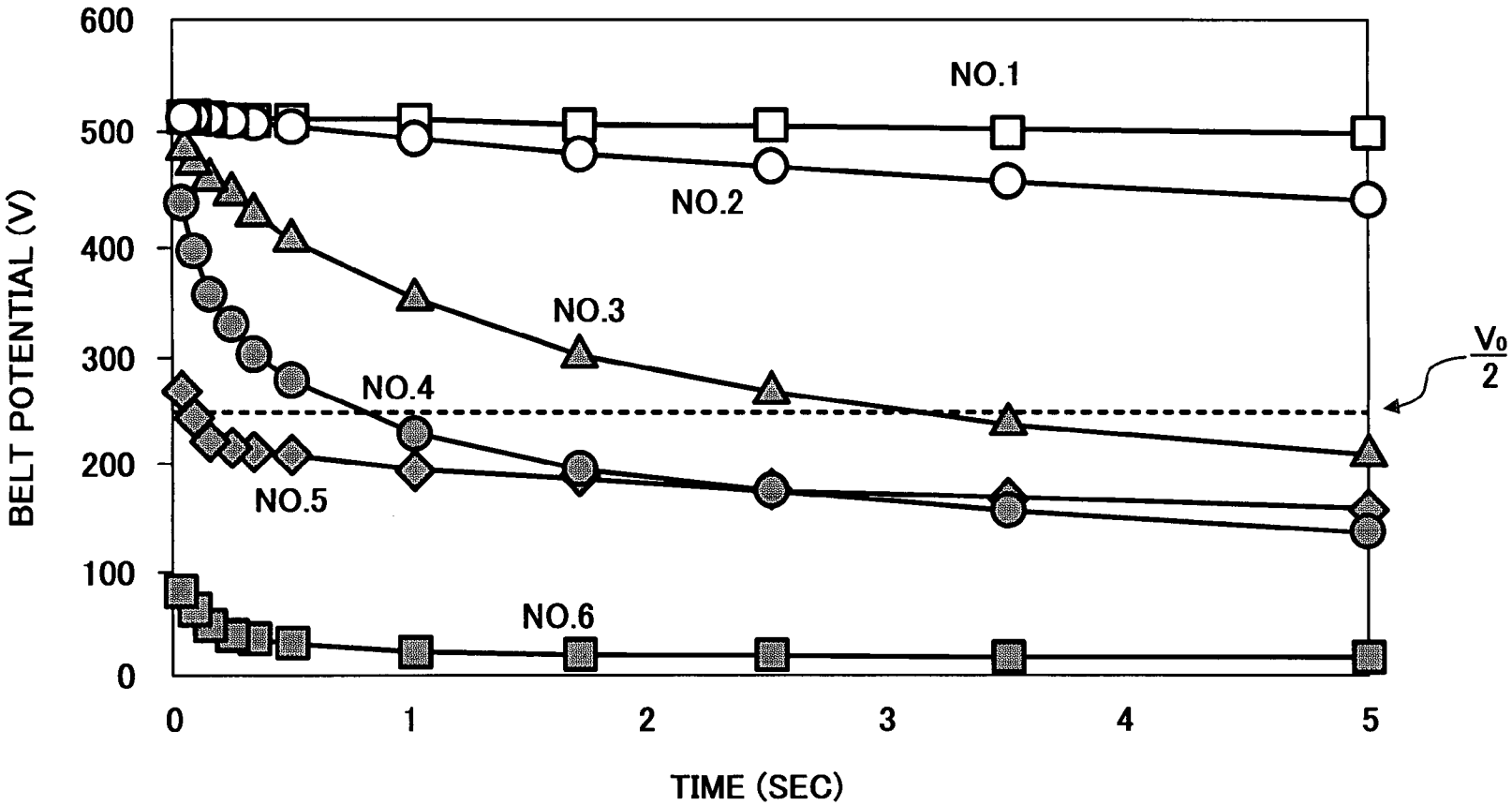
FIG. 18 is a graph showing a relation between a potential left on each of the six belts and time since the application of a voltage.

Experimental results indicative of a relation between the surface potential attenuation ratio of the belt 10 and irregular image transfer will be described hereinafter. FIG. 17 lists irregular image transfer ranks determined with six belts Nos. 1 through 6 each having a particular surface potential attenuation ratio by use of the copier of FIG. 1. Irregularity of image transfer was estimated on images. For estimation, the belt was provided with a circumferential length of 1,178 mm and moved at a linear velocity of 282 mm/sec. FIG. 18 shows curves each showing a potential left on particular one of the belts Nos. 1 through 6 after the application of 500 V.

The distance between nearby drums 40, i.e., nearby nips formed by nearby drums 40 and the belt 10 was selected to be 150 mm and was the same throughout the consecutive nips. In FIG. 17, a circle, a triangle and a cross respectively indicate "good", "allowable lower limit" and "no good".

As FIG. 17 indicates, when use was made of the belt No. 3 whose 5-second potential value was 207 V, the result of estimation was the lower limit. The belts Nos. 4 through 6 with 5-second potential values smaller than 207 V all were fully acceptable. On the other hand, the belts Nos. 2 and 1 with 5-second potential values of 436 V and 481 V, respectively, were not acceptable at all. This proves that the belt, having the surface potential attenuation ratio that decreases to ½ or below in 5 seconds, is successful to confine irregular image transfer in an allowable range.

As stated above, if the belt 10 has a 5-second potential value decreasing to ½ in 5 seconds after the application of the primary image transfer bias $V_o$, then the charge deposited on the belt 10 at the time of primary or secondary image transfer attenuates to a degree not effecting the next primary image transfer. More specifically, even if an irregular charge distribution, which is the replica of the potential distribution of the drum 40, appears on the belt 10, it does not remain in a critical amount at the time of the next primary image transfer. Moreover, even if charge of the same polarity as toner is deposited on the belt 10 at the secondary image transfer position, the potential does not remain in a critical amount at the time of the next primary image transfer.

In the tandem, intermediate image transfer type of apparatus configured to transfer a plurality of toner images to the belt 10 during one turn of the belt 10, the distance between nearby primary image transfer nips and the distance between the primary image transfer nip and the secondary image transfer nip tend to decrease. Therefore, a sufficient period of time is not available for the charge deposited on the belt 10 by, e.g., the voltage applied to the belt 10 to attenuate before the belt 10 again advances to the primary image transfer nip. Consequently, irregular image transfer occurs more than in an apparatus including a single photoconductive drum.

In the tandem apparatus, the bias for primary image transfer may be sequentially increased stepwise at the consecutive primary image transfer stations, so that transferability can be insured despite an increase in the surface potential of the belt 10. However, if the above bias is excessively high, then discharge occurs at the portions of the belt 10 where the surface potential is low, preventing the current from being used for primary image transfer and therefore lowering image transfer efficiency. Further, to increase the bias, a power supply with great capacity is necessary, resulting in an increase in cost.

It follows that the illustrative embodiment, capable of obviating irregular image transfer, is advantageous when applied to the tandem apparatus.

EXAMPLE 2

Example 2 is practicable with the same copier configuration as Example 1. This is also true with the other examples to follow. The following description will therefore concentrate on configurations unique to Example 2.

In Example 2, a period of time in which the surface potential of the portion of the belt 10 applied with a primary image transfer bias $V_0$ drops to $V_0/2$ is determined to be T seconds, which is the interval between the preceding and following primary image transfer. More specifically, T seconds is the interval between the time when a black toner image, which is the last one of four toner images constituting a composite color image, is transferred to the belt 10 and the time when a yellow toner image, which is the first one of four toner images, is transferred to the belt 10 after the secondary transfer of the above composite toner image to a sheet. Let the potential remaining on the belt 10 in T seconds be referred to as T-second potential.

Experimental results, indicating a relation between the surface potential attenuation ratio of the belt 10 in T seconds and irregular image transfer, will be described hereinafter. FIG. 17 additionally shows a relation between the surface potential attenuation ratio in T seconds and irregular image transfer determined with the belts Nos. 1 through 6 each having a particular surface potential attenuation ratio. T seconds can be produced by dividing the distance over which the belt 10 moves clockwise from 40Bk, FIG. 1, to 40Y, FIG. 1, via the rollers 14, 16 and 15 by the linear velocity:

$$T=\{1178-(150\times3)\}/282\approx2.6\ (\text{sec})$$

T seconds was therefore selected to be 2.6 seconds in Example 2.

As FIG. 17 indicates, the surface potential of the belt No. 3 dropped to 268 V in T (2.6) seconds since the application of the voltage of 500 V. Image transfer effected with the belt No. 3 was estimated to be "Δ", i.e., the allowable limit. The belts Nos. 4 through 6 whose surface potentials dropped more than the surface potential of the belt No. 3 all were estimated to be "○", i.e., acceptable. On the other hand, when the belts Nos. 2 and 1 whose surface potentials dropped only to 467 V and 489 V, respectively, were used, irregularity was estimated to be "x", i.e., not acceptable at all. It will therefore be seen that the belts Nos. 4 through 6 whose surface potentials drop to ½ or below in T seconds are successful to obviate irregular image transfer.

As stated above, if the surface potential of the belt 10 drops to ½ or below after the application of the primary image transfer bias $V_o$, but before the next primary image transfer, then the charge deposited on the belt 10 by the preceding primary image transfer can attenuate to such a degree that it does not effect the following primary image transfer. Therefore, even if an irregular potential distribution, which is the replica of the potential distribution on the drum 40, appears on the belt 10, the potential attenuates, before the above irregular potential distribution reaches the next primary image transfer nip, to such a degree that it obviates irregular image transfer. In addition, the potential on the belt 10 attenuates to such a degree that irregular image transfer ascribable to other factors is obviated.

EXAMPLE 3

In Example 3, the belt 10 is provided with surface resistivity of $10^7$ Ω/□ or above, but $10^{12}$ Ω/□ or below, on the inner surface thereof to which the primary image transfer bias Vo is applied. Hereinafter will be described experimental results indicating a relation between the surface resistivity of the inner surface of the belt 10 and image quality.

FIG. 19 shows the results of estimation effected with nine belts Nos. 7 through 15 each having particular surface resistivity by use of the copier shown in FIG. 1. More specifically, whether or not an image was defective was determined on the basis of an image transfer ratio and a discharge mark. Surface resistivity was measured by HYRESTER-UP mentioned earlier at temperature of 23° C. and humidity of 50%. The probe URS mentioned earlier was also used. The voltage applied was 500 V.

As FIG. 19 indicates, when the belt No. 7 with the surface resistivity of less than $1\times10^7$ Ω/□ on the inner surface was used, the image transfer ratio was lowered to an unacceptable degree "x". On the other hand, when the belt No. 15 with the surface resistivity of higher than $1\times10^{12}$ Ω/□ on the inner surface was used, discharge marks were found in the resulting image, so that the result of estimation was not acceptable as indicated by "x". It will therefore be seen that by confining the surface resistivity of the rear surface of the belt 10 in the range of from $1\times10^7$ Ω/□ to $1\times10^{12}$ Ω/□, it is possible to produce a desirable image whose image transfer ratio and discharge marks both lie in the acceptable range.

It will also be seen from FIG. 19 that the surface resistivity of the inner surface of the belt 10 and the 5-second potential or the T-second potential are not correlated to each other. Stated another way, the surface potential attenuation ratio of the belt 10 is not determined only by the surface potential of the inner surface of the belt 10.

The results of estimation shown in FIG. 19 may be accounted for by the following. If the surface resistivity of the inner surface of the belt 10 is lower than $1\times10^7$ Ω/□, then the current derived from the primary image transfer voltage Vo applied to the primary image transfer roller 62 flows along the inner surface of the belt 10. As a result, the current flows not only to the expected drum 40 but also to another drum 40 adjoining it and is likely to disturb image transfer at the another drum 40. On the other hand, if the surface resistivity of the inner surface of the belt 10 is higher than $10^{12}$ Ω/□, then the potential on the inner surface and the surface on the outer surface are unbalanced with the result that discharge is apt to occur between the belt 10 and a grounding member adjoining it. Such discharge causes a discharge mark to appear in the resulting toner image.

Considering the experimental results stated above, Example 3 uses, among the belts Nos. 8 through 14 with rear-surface resistivities lying in the above range, the belt No. 8, 9, 11, 12 or 14 whose 5-second potential and T-second potential both are ½ or less.

EXAMPLE 4

Figure 20:
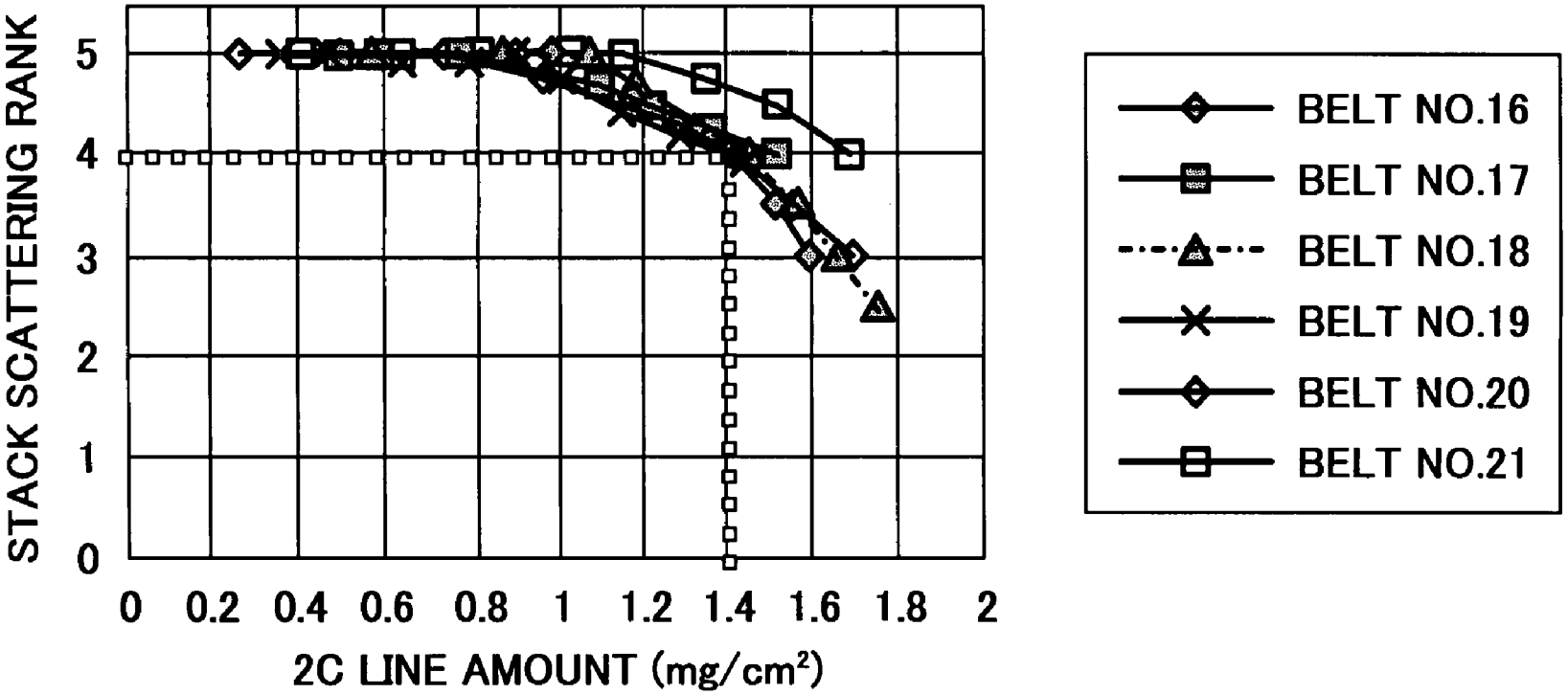
FIG. 20 is a graph of experimental results showing stack scattering ranks determined with other six intermediate image transfer belts different in surface resistivity from each other.

Generally, when toner images of different colors are sequentially stacked to form a full-color image, toner rises to substantial height and is likely to be scattered around. This kind of toner scattering (referred to as stack scattering hereinafter) is particularly conspicuous on characters and other line images. In light of this, in Example 4, the maximum amount of toner to deposit on a line portion included in a single-color toner image, which is to be transferred to the belt 10, is limited to 0.7 mg/cm$^2$. This will be described more specifically with reference to FIG. 20 showing experimental results. FIG. 21 lists the properties of belts Nos. 16 through 21 used for the experiment. The estimation of stack scattering shown in FIG. 20 was conducted with a modified machine of Imagio Color 5100 (trade name) available from RICOH CO., LTD. For estimation, the amount of toner to deposit on a two-color line image was varied so as to determine stack scattering ranks in numerical values.

Figure 22:
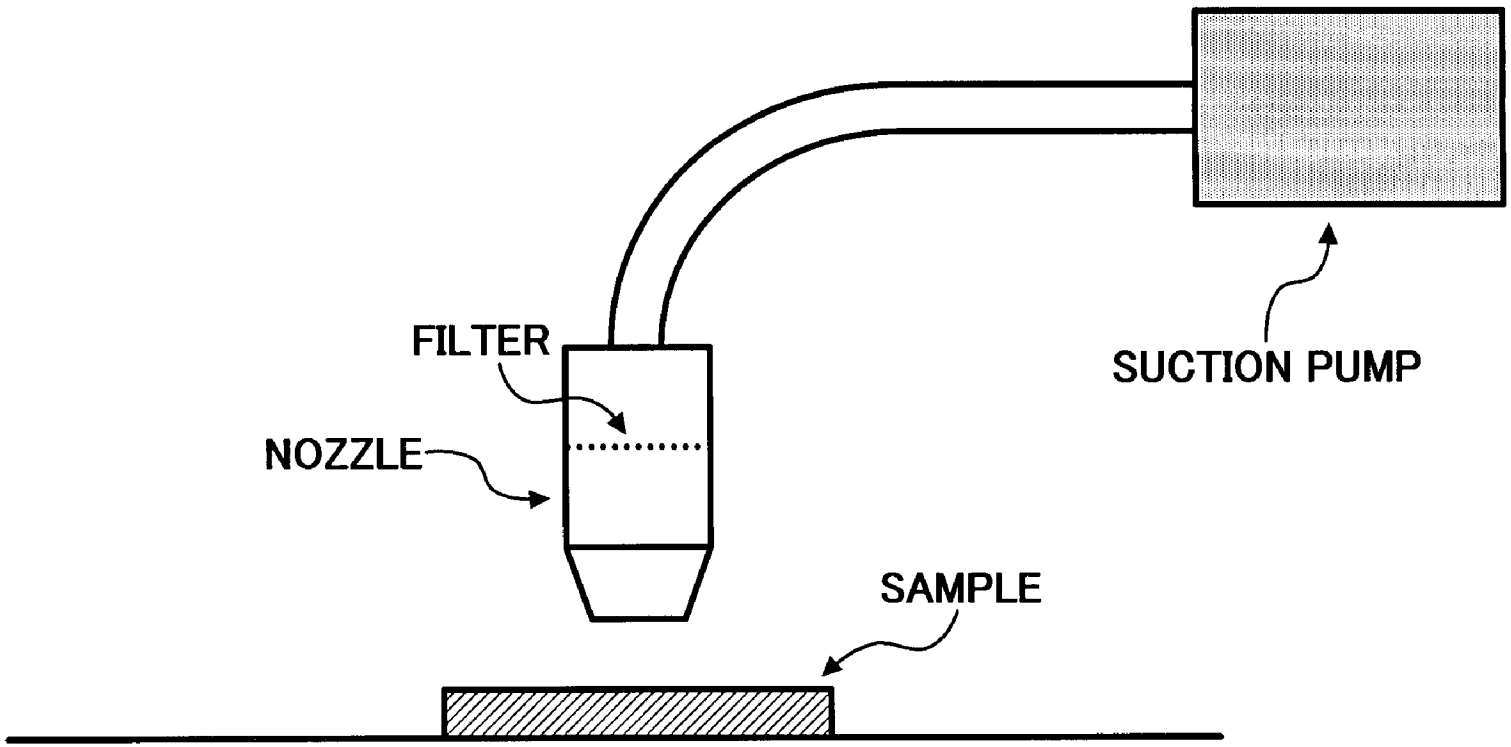
FIG. 22 is a plan view showing a device for measuring the amount of toner deposited.

Stack scattering is influenced by the amount of toner deposited on an image, as known in the art, and particularly critical on lines. In light of this, how the amount of toner deposited on a line portion is measured will be described first. FIG. 22 shows a device for measuring the amount of toner deposited while FIGS. 23 and 24 each show a particular image sample to be measured.

To measure the amount of toner with the device of FIG. 22, a nozzle, fluidly communicated to a suction pump and provided with a filter, sucks toner and stores it therein and is then removed from the pump. The weight of toner deposited is determined by subtracting the weight of the nozzle before suction from the weight of the same after suction.

Figure 23:
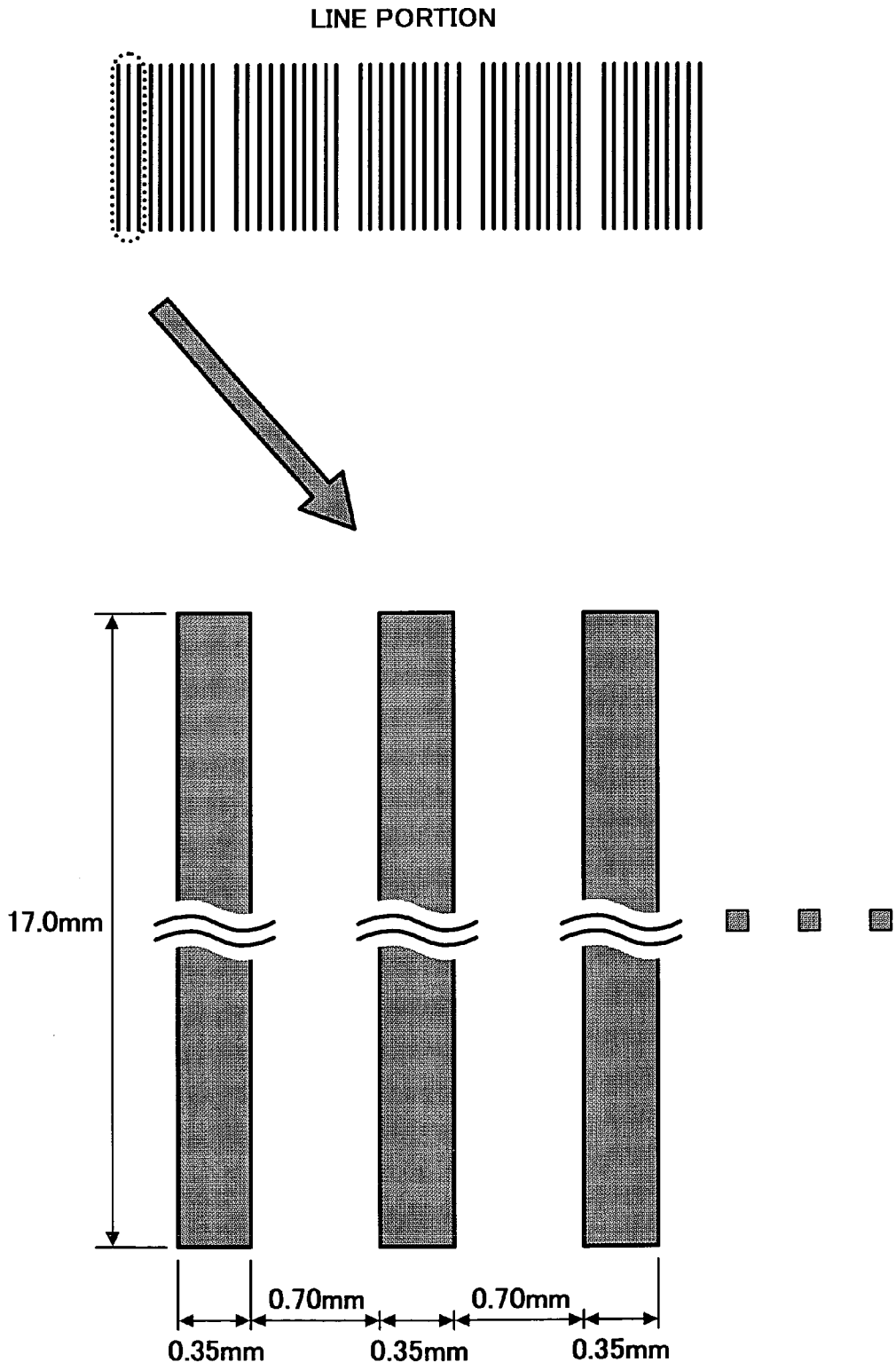
FIG. 23 shows a specific image sample representative of a line portion.
Figure 24:
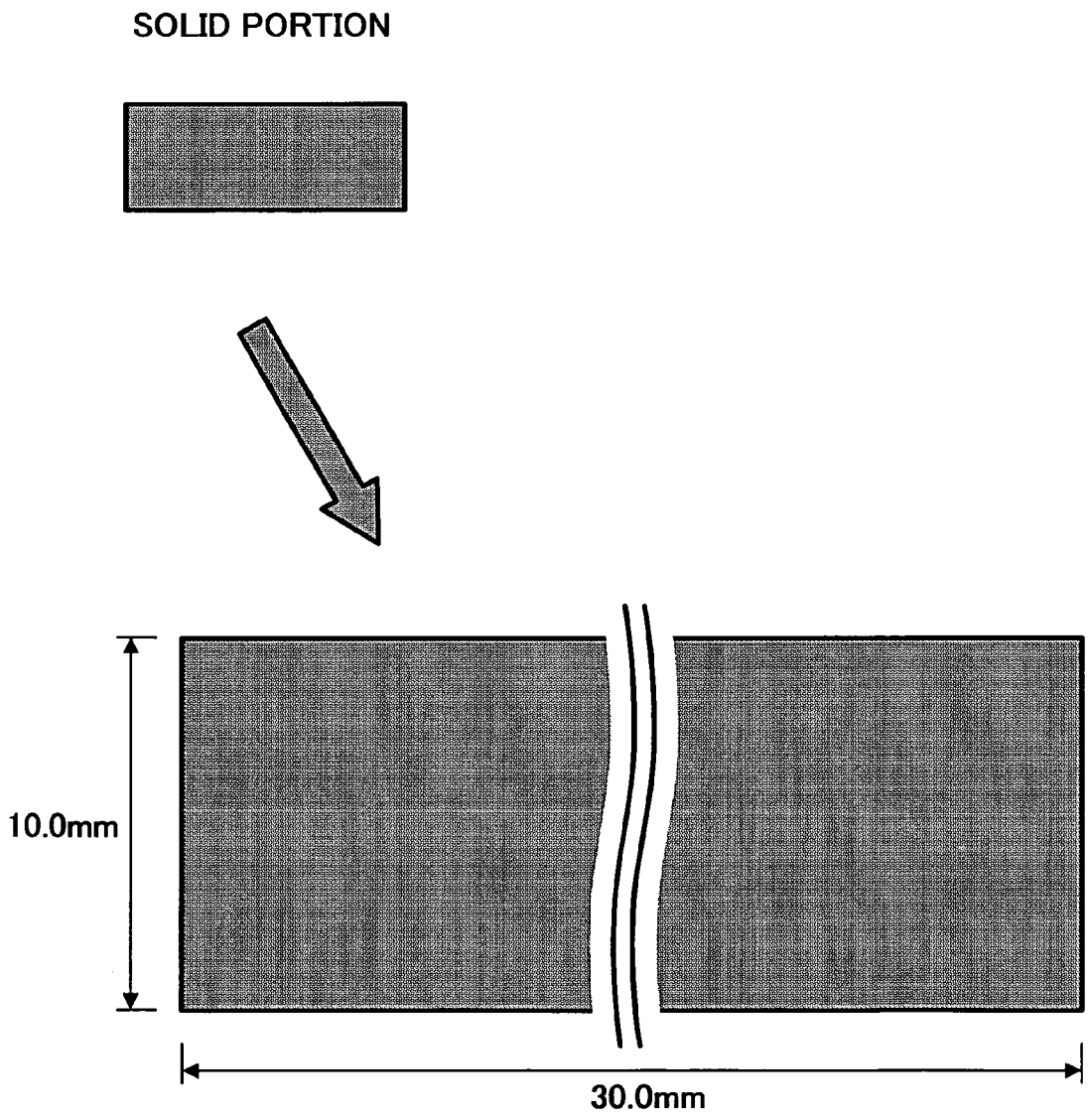
FIG. 24 shows a specific image sample representative of a solid portion.

The image samples shown in FIGS. 23 and 24 are a line image and a solid image, respectively, both of which have a total area of 3 cm$^2$. The amount of toner deposited on the line image or the solid image for a unit area can therefore be determined. More specifically, the image sample of FIG. 23 consists of five groups of ten lines each being 0.35 mm wide and 17.0 mm high while the image sample of FIG. 24 consists of a single solid image that is 30.0 mm wide and 10.9 mm high.

The device shown in FIG. 22 is operated to suck toner deposited on each of the above line image and solid image, and then the amount of toner deposited is determined in terms of weight. For the experiment, use is made of black toner. As for the solid image, the amount of toner is determined in terms of density by a spectral densitometer X-Rite 938 (trade name) after secondary image transfer, but before fixation.

A relation between the amount of toner deposited and stack scattering rank was determined with each of the belts Nos. 16 through 21, FIG. 21, with respect to a two-color line image. FIG. 25 lists the relation thus determined. FIG. 20 is a graph derived from the data shown in FIG. 25; the ordinate and abscissa indicate stack scattering ranks 1 through 5 and the amounts of toner, respectively. The higher the rank, the smaller the amount of stack scattering. Ranks 4 and 5 are satisfactory as to image quality.

As FIG. 20 indicates, when the belts Nos. 16 through 20 whose 5-second and T-second potentials both were ½ or below were used, the resulting relations between the amount of toner and stack scattering did not noticeably differ from each other, but showed similar tendency. This indicates that if the amount of toner deposited on a two-color line image is 1.4 mg or less, i.e., 0.7 mg or less for a single color, then the stack scattering rank 4 or above is achievable. This is why Example 4 limits the maximum amount of toner to deposit on the line portion of a single-color toner image, which is to be transferred to the belt 10, to 0.7 mg/cm$^2$.

EXAMPLE 5

Assume that the maximum amount of toner to deposit on the line portion of a single-color toner image, which is to be transferred to the belt 10 is a mg/cm$^2$, and that the maximum amount of toner to deposit on the solid portion of a single-color toner image is b mg/cm$^2$. Then, in Example 5, the ratio of the amount a to the amount b (referred to as a line/solid ratio a/b hereinafter) is confined in the range of:

$$1.0 \leqq a/b \leqq 1.4$$

Figure 26:
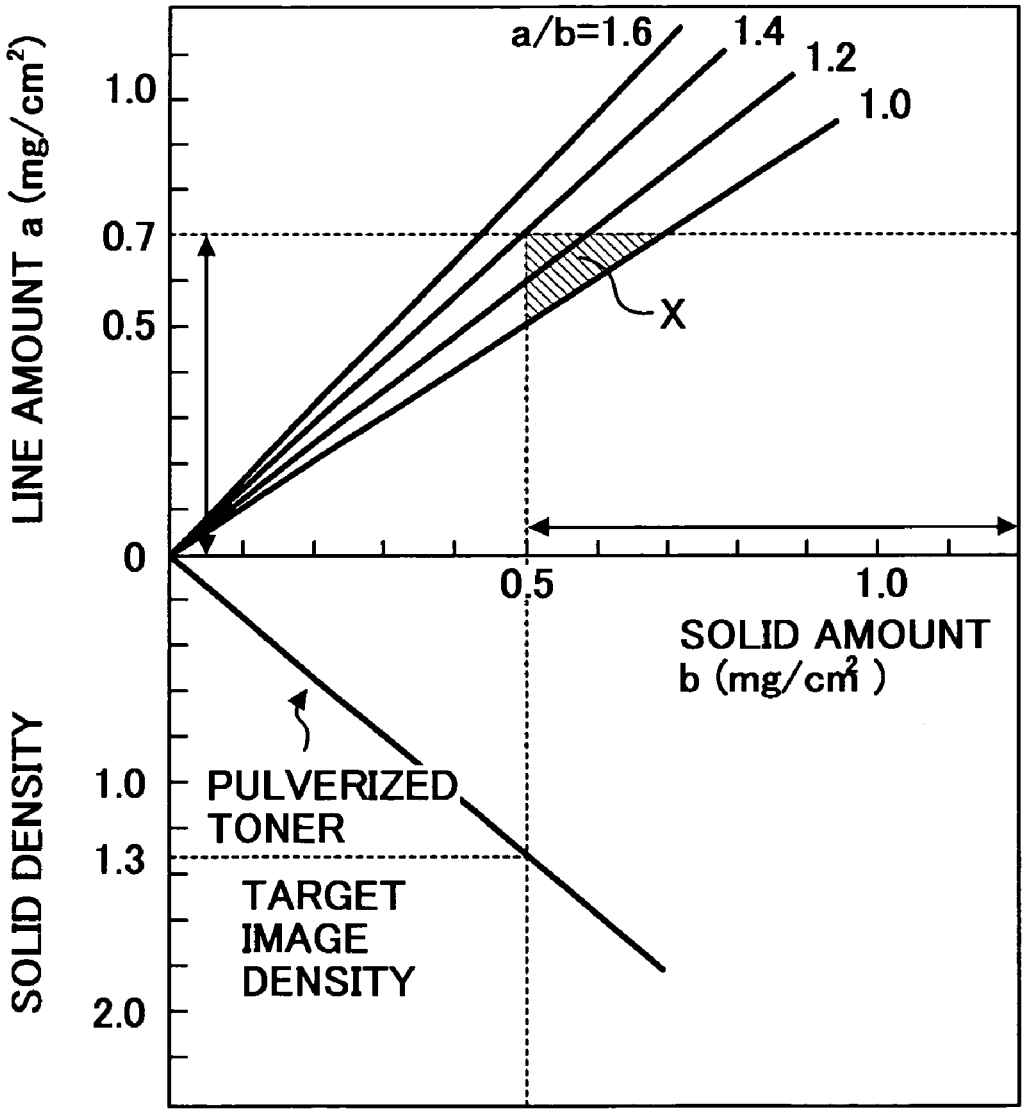
FIG. 26 is a graph showing the amount of toner deposited on the solid portion, the density of the solid portion and the amount of toner deposited on the line portion particular to the alternative embodiment.

More specifically, FIG. 26 is a graph showing the amount of toner deposited on and the density of a solid portion, and the relation between the amount of toner deposited on the solid portion (solid amount hereinafter) and the amount of toner deposited on a line portion (line amount hereinafter) with respect to various ratios a/b. The amount of toner deposited was measured in the same manner as in Example 4.

Generally, the target density of a solid image is 1.3 or above. As FIG. 26 indicates, to implement such image density, the solid amount must be 0.5 mg/cm$^2$ or above when use is made of pulverized toner. To implement the solid amount of 0.5 mg/cm$^2$ or above and to obviate stack scattering stated in relation to Example 4, the line amount must be 0.7 mg/cm$^2$ or below. This condition can be satisfied if the line/solid amount ratio is 1.4 or below. Further, the ratio a/b is generally not less than 1.0 because toner deposits on a line portion more than on a solid portion for a unit area because of, e.g., the edge effect known in the art.

For the reasons stated above, the above conditions can be satisfied at the same time if the ratio a/b lies in the range of $1.0 \leqq a/b \leqq 1.4$. If this condition is satisfied, then it is possible to obviate stack scattering while insuring solid image density of 1.3 or above.

In a zone X indicated by hatching in FIG. 26, there are satisfied all of the conditions that the solid amount be 0.5 mg/cm$^2$ or above, that the line amount be 0.7 mg/cm$^2$ or below, and that the ratio a/b be 1 or above. In FIG. 26, lines with numerical values of 1.0, 1.2, 1.4 and 1.6 indicate line/solid ratios a/b; the longer the part of the line lying in the zone X, the greater the margin as to the above three conditions required. It will therefore be seen that as the ratio a/b approaches 1.0, there can be obviated stack scattering more positively while insuring the solid image density of 1.3 or above.

Figure 27:
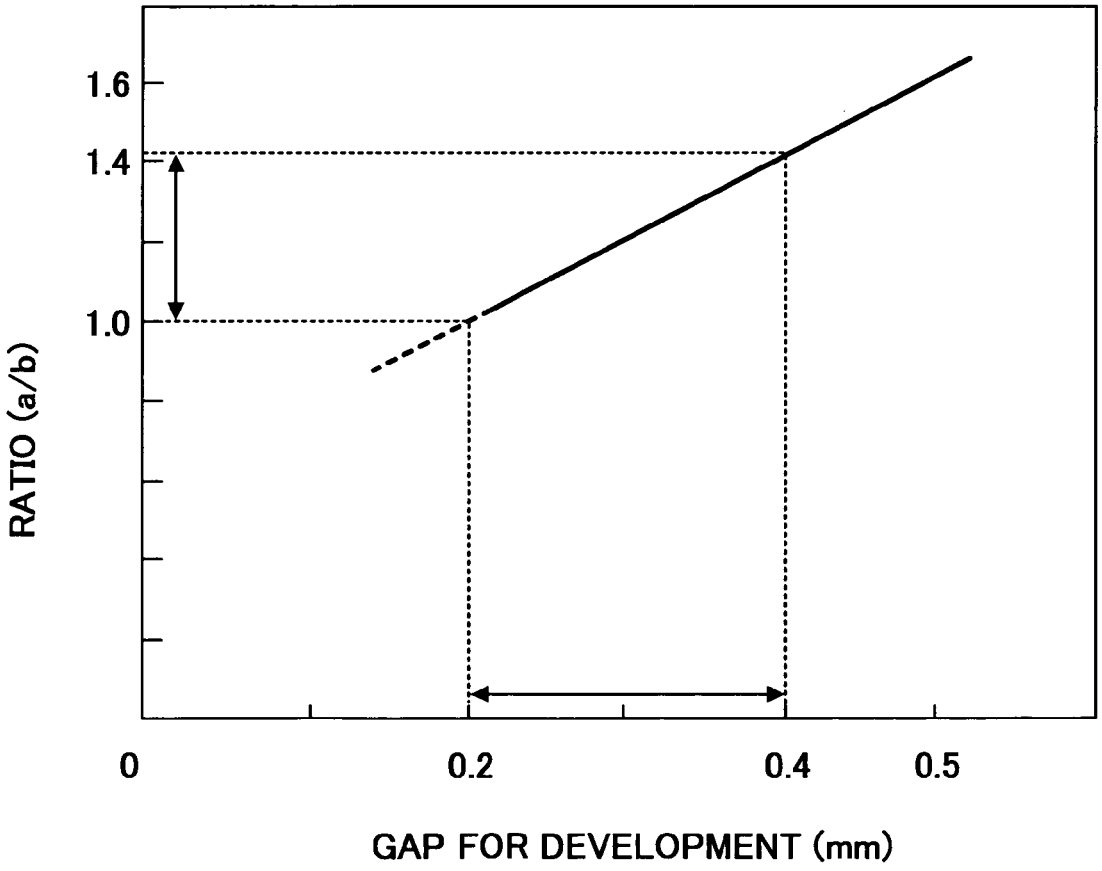
FIG. 27 is a graph showing a relation between the gap for development and the ratio of the amount of toner deposited on the line portion to the amount of toner deposited on the solid portion.

A method of satisfying the range of the ration a/b stated above will be described hereinafter. FIG. 27 is a graph showing a relation between a gap Gp for development and the ratio a/b. The gap Gp refers to a distance between the sleeve for depositing toner on the drum 40 and the drum 40. As shown, the gap Gp and ratio a/b have a positive correlation; the ratio a/b increases with an increase in gap Gp. It is therefore possible to confine the ratio a/b in the range of from 1.0 to 1.4 by adjusting the gap Gp. In the illustrative embodiment, if the gap Gp is between 0.2 mm and 0.4 mm. then the ratio a/b can be confined in the range of from 1.0 to 1.4. This, however, depends on the linear velocity ratio of the sleeve to the drum and other conditions for the developing device as well as on the carrier resistance of a developer. In the illustrative embodiment, the above linear velocity ratio is selected to be 2.0 while use is made of a developer whose carrier resistance is $1\times10^{10}$ Ω lying in the usual range of from $1\times10^{9}$ Ω to $1\times10^{13}$ Ω.

Another method of confining the ratio a/b in the particular range stated above is to adjust the resistance of carrier grains that convey toner grains electrostatically deposited thereon to the drum 40. For example, by lowering the resistance of the carrier grains, it is possible to reduce the strength of an electric field at the contour of an image between the sleeve and the drum 40 and therefore to prevent toner grains form depositing more on the contour than on the other portion of the image. This reduces to a certain degree an occurrence that the line amount becomes larger than the solid amount, thereby limiting the ratio a/b to 1.4 or below.

Example 5 will be described in relation to Comparative Example 5 hereinafter. Pulverized toner with circularity of 0.91 was used. The belt 10 had surface resistivity of $1.13\times10^{10}$ Ω/□ on the inner surface, a 5-second potential of 11 V, a T-second potential of 16 V, and thickness of 85 m. The belt 10 was implemented as a single-layer seamless belt formed of polyimide with carbon black dispersed therein. The gap Gp for development was 0.3 mm in Example 5 or 0.5 mm in comparative Example 5. FIG. 28 shows the results of experiments conducted with Example 5 and comparative Example 5

As FIG. 28 indicates, when the gap Gp is 0.3 mm as in Example 5, the line amount decreases for given solid density, compared to the gap of 0.5 selected in Comparative Example 5. It is therefore possible to limit the ratio a/b to 1.4 or below for thereby reducing stack scattering.

EXAMPLE 6

Use was made of toner having mean circularity of 0.95 or above. The belt 10 had the same configuration as in Example 5. Although the spherical toner was polymerized toner formed of modified polyester, the material and production method are open to choice.

The mean circularity of toner is measured by a flow type, grain image analyzer FPIA-2100 available from SYSMEX. More specifically, a 1% NaCl aqueous solution is prepared by use of primary sodium chloride and then passed through a 0.45 μm filter. After 0.1 ml to 5 ml of surfactant, preferably alkylbenzene sulfonate, has been added as a dispersant to 50 ml to 100 ml of the resulting solution, 1 mg to 10 mg of sample was added. The resulting mixture is dispersed for 1 minute by an ultrasonic dispersing device to thereby prepare a dispersion whose grain density is between 1,000/μl to 15,000/μl. Assuming that the diameter of a circle having the same area as a bidimensional image picked up by a CCD (Charge Coupled Device) camera is a diameter corresponding to a circle, diameters of 0.6 m and above are determined to be valid on the basis of the accuracy of the CCD camera and used to calculate mean circularity. Mean circularity can be determined by adding the circularity of such grains and then dividing the sum by the number of grains. Further, the mean circularity of the individual grain can be calculated by dividing the circumferential length of a circle identical in projection area as the grain image by the circumferential length of the projected image of the grain.

Figure 29:
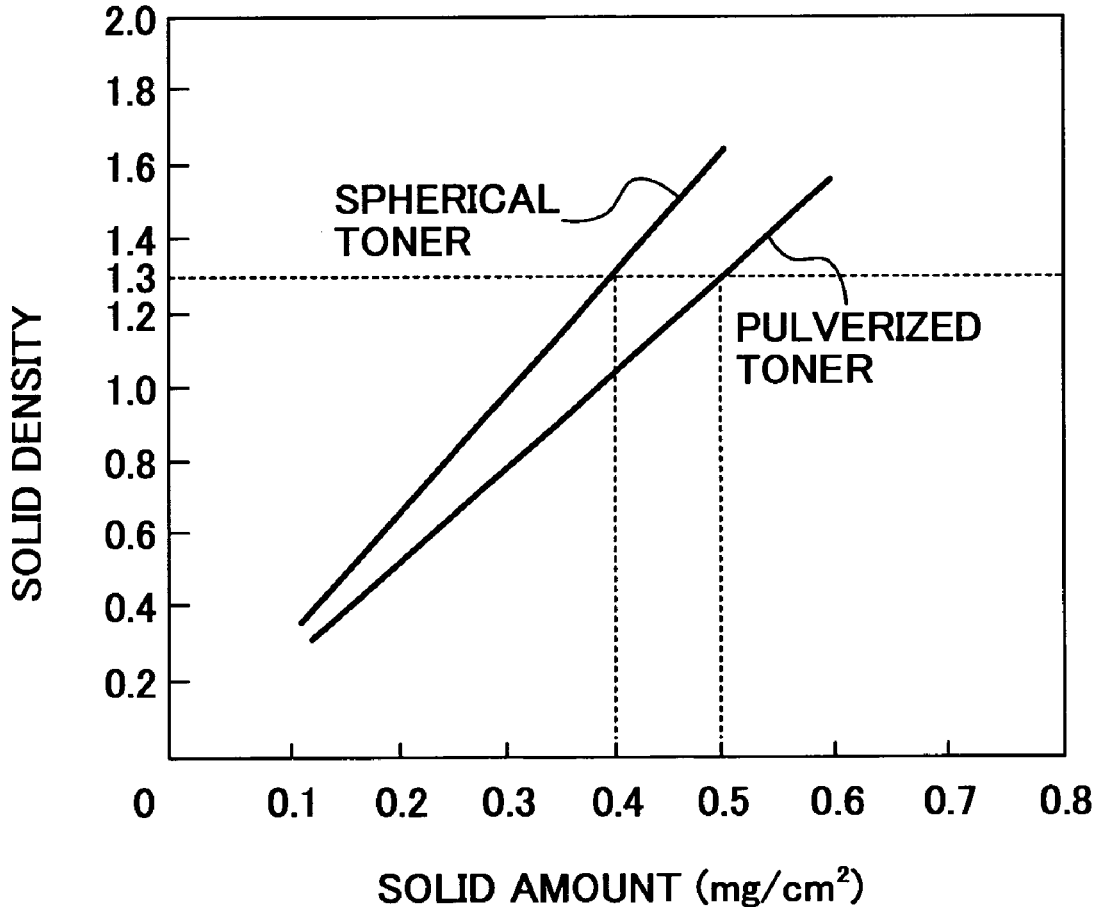
FIG. 29 is a graph showing experimental results showing a relation between the amount of toner deposition and the image density of the solid portion and determined with pulverized toner and spherical toner.

FIG. 29 shows a relation between the solid amount and the solid image density determined by experiments with conventional pulverized toner and spherical toner. The pulverized toner and spherical toner had mean circularities of 0.91 and 0.98, respectively. As FIG. 29 indicates, when pulverized toner is used, the target solid image density of 1.3 is not attainable unless the solid amount is 0.5 mg/cm$^2$ or above. By contrast, when spherical toner is used, the target density of 1.3 is attainable only if the solid amount is 0.4 mg/cm$^2$ because spherical toner can be packed more density than pulverized toner. This is why Example 6 uses spherical toner.

Figure 30:
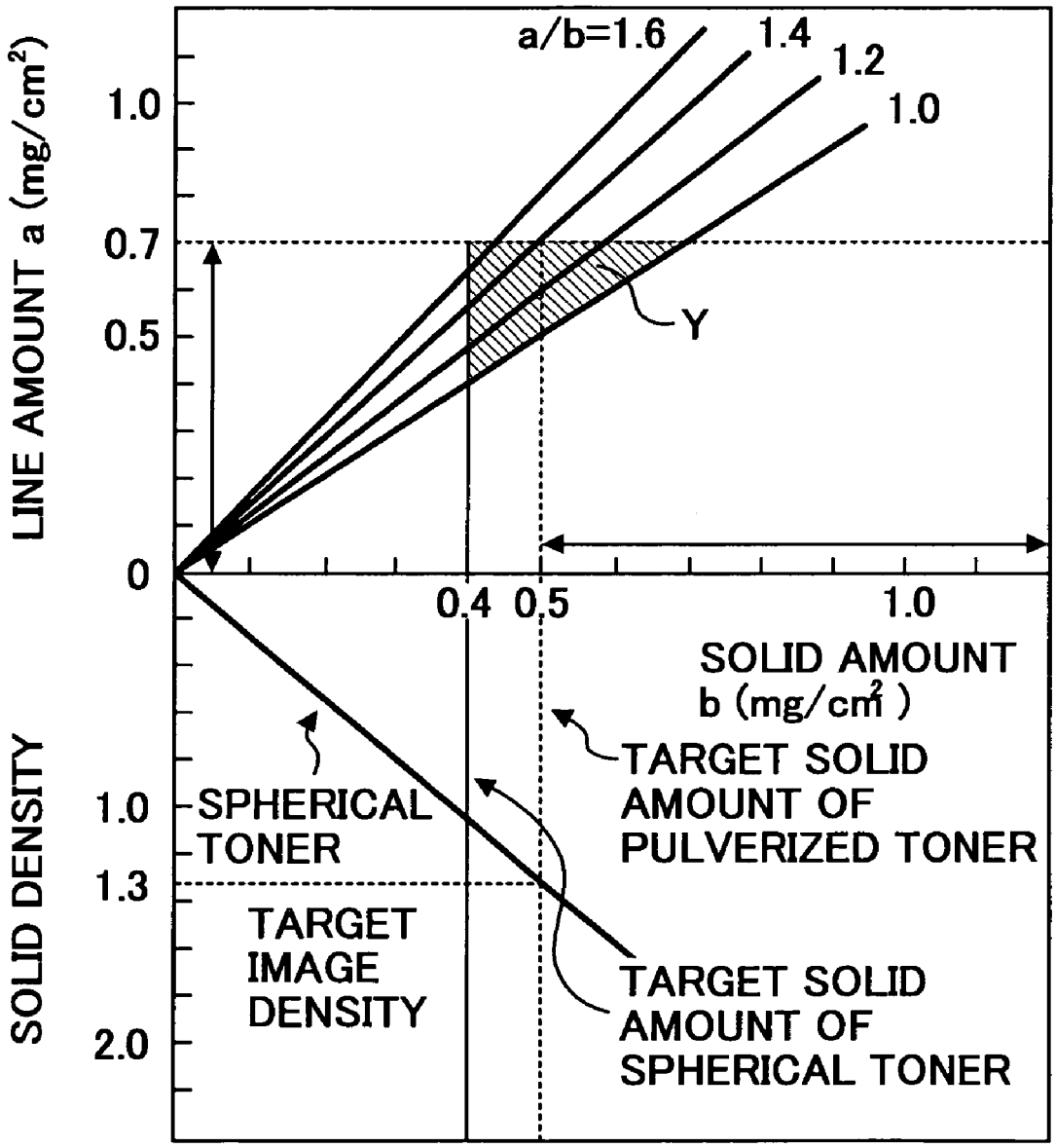
FIG. 30 is a graph showing a relation between the density and the amount of toner deposition of the solid portion and the amount of toner deposited on the line portion determined with spherical toner.

FIG. 30 is a graph showing a relation between solid image density, solid amount and line amount determined with spherical toner. As shown, the solid amount should be 0.4 mg/cm$^2$ or above while the line amount should be 0.7 mg/cm$^2$ or above in order to obviate stack scattering as stated earlier. These conditions are satisfied if the ratio a/b is 1.6 or below. Further, the ratio a/b is generally not less than 1.0, as stated in relation to Example 5.

Thus, the solid amount of 0.4 mg/cm$^2$ or above, line amount of 0.7 mg/cm$^2$ or below and ratio a/b of 1 or above all are achievable with spherical toner in a zone Y indicated by hatching in FIG. 30. The zone Y is larger in area than the zone X shown in FIG. 26 and derived from pulverized toner. It will therefore be seen that a broader a/b range and therefore a greater margin is achievable with spherical toner than with pulverized toner. Spherical toner therefore increases a margin as to the amount of deposition.

Toner with circularity of 0.93 or below cannot form a layer having a uniform thickness and a uniform surface, so that the chance that the toner contacts a sheet or the belt 10 decreases. This lowers image transfer efficiency and therefore makes it necessary to increase the image transfer current to thereby aggravate discharge in the event of separation. By contrast, spherical toner with high mean circularity makes the short image density discussed above difficult to occur even when a relatively low amount of toner deposition is selected, increasing the margin as to the ratio a/b.

The shape of toner is represented by shape indices SF-1 and SF-2. SF-1 and SF-2 are defined by randomly sampling the images of a hundred toner grains having grain sizes of 2 μm and above and enlarged by, e.g., FE-SEM (S-800) (trade name) available from HITACHI by 1,000. More specifically, the image information of 100 toner grains randomly sampled are input to, e.g., an image analyzer Luzex III available from NICORE via an interface and then analyzed.

The shape indices SF-1 and SF-2 respective indicate the degree of circularity and the degree of irregularity of the individual toner grain. When SF-1 is smaller than 135, the shape of toner approaches amorphousness away from circularity and cannot form a layer having a uniform thickness and a uniform surface, resulting in the problem stated above.

Example 6, successfully reducing stack scattering with the particular gap and spherical toner, will be described in relation to Comparative Example 6 using pulverized toner hereinafter. Circular toner and pulverized toner had circularities of 0.91 and 0.98, respectively. The belt 10 was implemented by a seamless single-layer belt formed of polyimide with carbon black dispersed therein. The belt 10 had a 5-second potential of 11 V and a T-second potential of 16 V, as measured by the device of FIG. 16, and thickness of 85 μm. The gap for development was 0.4 mm in both of Example 6 and Comparative Example 6. FIG. 31 compares Example 6 and Comparative Example 6 by using experimental results.

As FIG. 31 indicates, Example 6, using spherical toner, reduces the line amount to 0.58 mg/cm$^2$ smaller than that attainable with Comparative Example 6, which uses pulverized toner, for substantially the same solid image density, realizing stack scattering rank 5. Also, as for the omission of the inside of an image ascribable to image transfer pressure, Example 6 is superior to Comparative Example 6 because spherical toner is packed more densely than pulverized toner and therefore lower in the height of a toner image than pulverized toner, so that the stress concentration of a toner image at the image transfer position is reduced.

In Example 6, in the zone Y shown in FIG. 30, the solid amount is 0.5 mg/cm$^2$ or above while the line amount is 0.7 mg/cm$^2$ or below for obviating stack scattering. A ratio a/b of about 1.6 or below suffices to satisfy the above conditions. Further, because the ratio a/b is generally not less than 1.0, the ratio should only lie in the range of $1.0 \leqq a/b \leqq 1.6$. This means that the a/b range is broader than in Example 5 using pulverized toner.

EXAMPLE 7

Figures 32, 33:
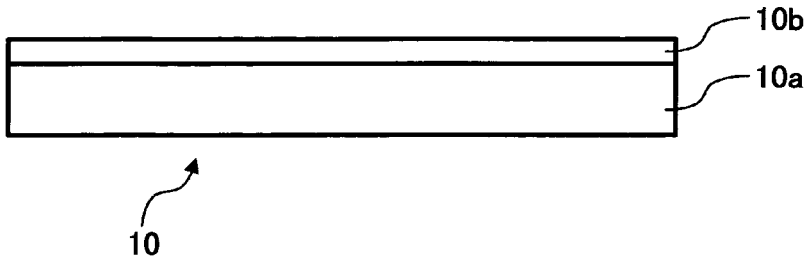
FIG. 32 is a section showing an intermediate image transfer belt particular to Example 7 of the alternative embodiment.
FIG. 33 is a table comparing the belt of FIG. 32 with a belt lacking a surface layer as to image quality.

As shown in FIG. 32, the belt 10 used in Example 7 is made up of a base layer 10*a* and a surface layer 10*b*. In Example 7, the surface layer 10*b* was formed of PTFE (polytetrafluoroethylene), which is fluorine-based resin. While fluorine-based resin may be any one of TFE (tetrafluoroethylene), FET (tetrafluoroethylene-hexafluloroethylene copolymer) and so forth, such a material is only illustrative. PTFE was coated on the base layer 10*a* to thickness of 5 μm. A belt No. 22 having the same base layer 10*a* as the above belt 10, but lacking the surface layer 10*b*, was prepared. FIG. 33 compares the belt No. 22 and the belt, designated by No. 23, having both of the base layer 10*a* and surface layer 10*b* as to image quality.

As FIG. 33 indicates, the belt No. 23 with the surface layer 10*b* reduced irregular image transfer more positively than the belt No. 22. Further, the belt 23 allowed toner left thereon after secondary image transfer to be removed more desirably than the belt 24. More specifically, when portions where toner strongly adheres to the belt, e.g., where many colors are stacked exist, the toner is apt to remain on the belt and bring about irregular image transfer. Example 7, promoting the separation of toner from the belt 10, desirably obviates even this kind of irregular image transfer. In addition, toner can be easily peeled off from the belt 10, so that efficient cleaning is achievable.

As stated above, in the illustrative embodiment, assuming that the weight-mean grain size and number-mean grain size of toner are Xw and Xn, respectively, then a ratio Xw/Xn should preferably be 1.35 or below. If the ratio Xw/Xn is greater than 1.35, then the thickness and surface of a toner layer are not uniform in the same manner as described in relation to the shape index SF-1, lowering image transfer efficiency. As a result, it is likely that the image transfer current increases and aggravates discharge at the time of separation.

In the illustrative embodiment, the cohesion of toner should preferably be small, so that the thickness of a toner layer between the belt 10 and a sheet be uniformed. Further, the uniform surface of a toner layer allows an even electric field to act on the individual toner grains for thereby enhancing efficient image transfer. Moreover, there can be reduced the amount of charge to deposit on a sheet and therefore toner scattering ascribable to discharge at the time of separation. The cohesion of toner may be represented by a degree of cohesion (%); the higher the degree of cohesion, the stronger the cohesion or toner.

To measure the degree of cohesion, use was made of POWDER TESTER TYPE PT-N available from HOSOKAWA MICRONS. POWDER TESTER was operated in accordance with its operation manual except that 75 μm, 45 μm and 22 μm sieves were used and that vibration time was 30 seconds. The degree of cohesion of toner should be between 5% and 20%, preferably between 5% and 15%. A degree of cohesion below 5% would make the fluidity of toner excessively high and cause toner to be easily scattered at the time of image transfer. A degree of cohesion above 20% would obstruct the transfer of toner.

When the secondary image transfer bias $V_1$ is applied to the belt 10 at the secondary image transfer position as in the illustrative embodiment, irregularity occurs in a toner image transferred to the belt 10 by primary image transfer, as determined by experiments. More specifically, the surface potential of the belt 10 moved away from the secondary image transfer nip N2 differs from the portion of the belt 10 facing a sheet to the other portion not facing it, resulting in a potential contrast. This potential contrast sometimes remains on the belt 10 up to the primary image transfer nip following the secondary image transfer nip N2. If the next toner image is transferred to the belt 10 by primary image transfer over the portions of the belt 10 where the potential contrast exists, stripe-like density irregularity occurs in accordance with the potential contrast.

EXAMPLE 8

Example 8 is capable of obviating irregular image transfer ascribable to the potential contrast stated above. In Example 8, a belt whose surface potential decreased to $V_1/2$ or below in 5 seconds after the application of the secondary image transfer bias $V_1$ was used as the belt 10. Again, the device shown in FIG. 16 was used to measure the surface potential attenuation ratio of the belt 10.

FIG. 34 shows experimental results showing a relation between the surface potential attenuation ratio of the belt 10 and irregular image transfer. For experiments, images were formed with belts Nos. 1 through 6 different in surface potential attenuation ratio from each other and the copier of FIG. 1. Image irregularity was estimated on images finally output. The distance between the secondary image transfer nip and the primary image transfer nip assigned to the first color was selected to be 410 mm. Each belt was provided with a circumferential length of 1,178 mm and caused to run at a linear velocity of 282 mm/sec.

As FIG. 34 indicates, when use was made of the belt No. 3 whose 5-second potential after the application of 500 V was 207 V, irregularity was estimated to be the allowable limit, "Δ". The belts Nos. 4 through 6 whose 5-second potentials were even lower than 207 V all were acceptable, "○". On the other hand, the belts Nos. 2 and 1 whose 5-second potentials were only 436 V and 481 V, respectively, were not allowable at all, "x". It will therefore be seen that if the 5-second potential of the belt 10 decreases to $V_1/2$ or below after the application of the secondary image transfer bias $V_1$, then the charge of the belt 10 deposited by secondary image transfer successfully attenuates to a degree not disturbing the next primary image transfer.

Thus, even when an irregular potential distribution, which is the replica of the potential distribution of a latent image formed on the drum 40, appears on the belt 10, it does not remain to a critical degree when the belt 10 arrives at the next primary image transfer nip.

EXAMPLE 9

Example 9 is identical with Example 8 as to the configuration of the copier except for the following. In Example 9, a period of time in which the surface potential of the belt 10 attenuates to $V_1/2$ after the application of the secondary image transfer bias $V_1$ was selected to be U seconds, which was the interval between secondary image transfer and the primary image transfer following it. Let the potential remaining on the belt 10 in U seconds be referred to as a U-second potential hereinafter.

Experimental results representative of a relation between the U-second potential and irregular image transfer will be described hereinafter. U seconds can be calculated by dividing a distance between the secondary image transfer nip N2, FIG. 35, and the primary transfer nip N1 assigned to the first color in the direction of movement of the belt 10 by the linear velocity of the belt 10:

$$410/282 \approx 1.45 \text{ seconds}$$

As FIG. 34 indicates, when the belt No. 3 whose U-second (1.45 seconds) was 311 V was used, irregularity was estimated to be the allowable limit, "Δ" The belts Nos. 4 through 6 whose U-second potentials were even lower than 207 V all were acceptable, "○". On the other hand, the belts Nos. 2 and 1 whose U-second potentials were only 80 V and 485 V, respectively, were not allowable at all, "x". It will therefore be seen that if the U-second potential of the belt 10 decreases to ½ or below after the application of the secondary image transfer bias $V_1$, then the charge of the belt 10 deposited by secondary image transfer successfully attenuates to a degree not disturbing the next primary image transfer.

Thus, even when an irregular potential distribution, which is the replica of the potential distribution of a latent image formed on the drum 40, appears on the belt 10, it does not remain to a critical degree when the belt 10 arrives at the next primary image transfer nip. Also, the potential on the belt 10 attenuates to a degree that obviates irregularity ascribable to other factors.

Figure 35:
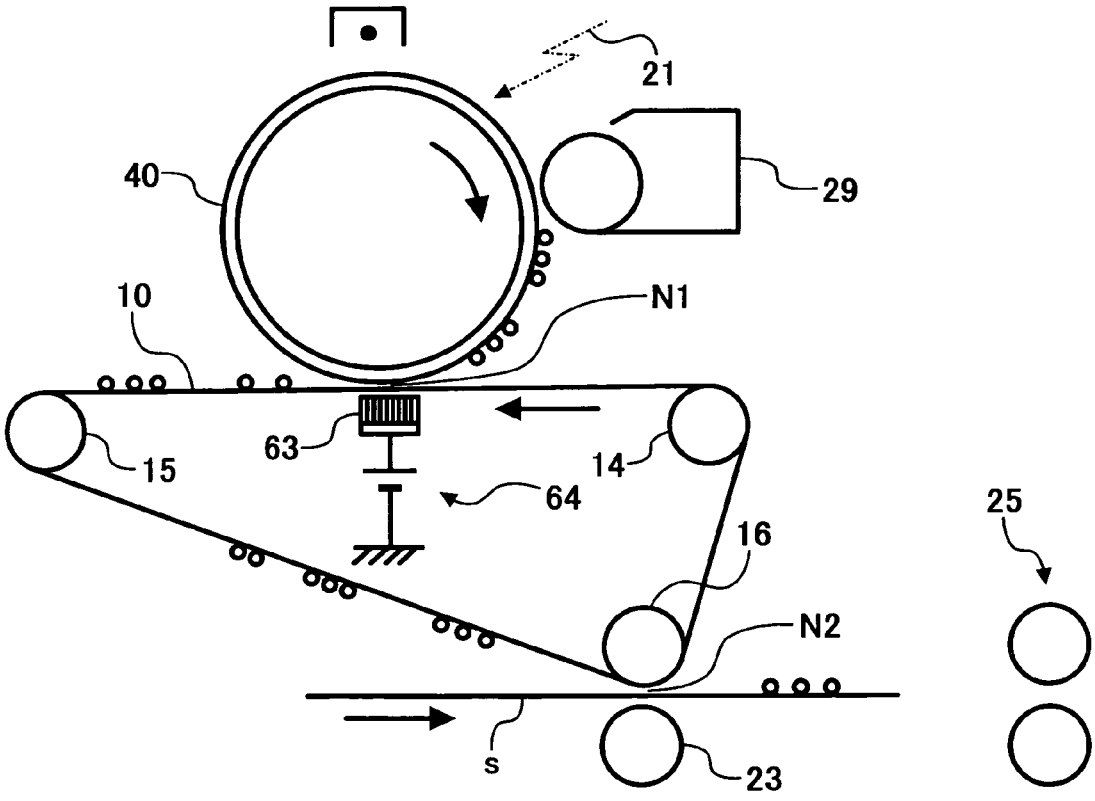
FIG. 35 is a fragmentary view showing a color copier representative of another alternative embodiment of the present invention.

Reference will be made to FIG. 35 for describing another alternative embodiment of the present invention. As shown, the drum or image carrier is movable in a direction indicated by an arrow. Conventional negative-to-positive image forming means forms a toner image of preselected polarity on the drum 40. The toner image forming means includes a charger for uniformly charging the surface of the drum 40 to negative polarity, the exposing device 21 for exposing the charged surface of the drum 40 imagewise, and the developing device 29 for developing the resulting toner image with toner to thereby produce a corresponding toner image.

In the case of a full-color image forming apparatus, four developing devices are arranged around the drum 40 and respectively assigned to, e.g., yellow, magenta, cyan and black, although not shown specifically. The belt 10 is passed over a plurality of rollers 14 through 16 and movable at substantially the same linear velocity as the surface of the drum 40 in a direction indicated by an arrow in FIG. 35. The rollers 14 and 15 are so arranged as to allow the belt 10 to contact the drum 40.

A conductive brush or primary image transferring means 63 is held in contact with the inner surface of the belt 10 and applies the primary image transfer bias $V_o$ to the belt 10 for thereby transferring the toner image from the drum 40 to the belt 10. A power supply 64 applies a bias opposite in polarity to the polarity of toner, i.e., a positive bias in the illustrative embodiment to the conductive brush 63. An electric field formed between the belt 10 and the drum 40 by the brush 63 transfers the toner image of negative polarity from the drum 40 to the belt 10.

The brush 63 may, of course be replaced with a roller formed of conductive rubber or a blade formed of a conductive material or even with a corona charger, if desired.

The toner image transferred to the belt 10 is transferred to a sheet S by a secondary image transfer roller or secondary image transferring means 23. Subsequently, the toner image on the sheet is fixed by the fixing unit 25.

As stated above, the second and third embodiments described above, implemented as an intermediate image transfer type of image forming apparatus each, obviate irregular image transfer otherwise occurring at the time of primary image transfer N1 due to an irregular potential distribution deposited on the intermediate image transfer body at the time of primary image transfer N1 preceding the above image transfer.

Further, there can be obviated irregular image transfer otherwise occurring at the time of primary image transfer N1, which follows secondary image transfer N2, due to the potential contrast of the intermediate image transfer body occurred at the time of secondary image transfer N2.

Various modifications will become possible for those skilled in the art after receiving the teachings of the present disclosure without departing from the scope thereof.

What is claimed is:

1. An intermediate image transfer type of image forming apparatus comprising:

an image carrier;

an intermediate image transfer body;

primary image transferring means for transferring a toner image formed on said image carrier to one surface of said intermediate image transfer body; and secondary image transferring means for transferring the toner image from said intermediate image transfer body to a recording medium;

wherein said primary image transferring means comprises primary bias applying means for applying a primary image transfer bias to the other surface of said intermediate image transfer body opposite to the one surface, and wherein when a surface resistivity of said intermediate image transfer body is measured by a method that repeatedly applies a voltage v1 of 200 V for a period of time t1 of 60 seconds to said intermediate image transfer body and grounds said intermediate image transfer body for a period of time t2 of 10 seconds a number of times N1 of 1,000, a difference in absolute value between a logarithm of a first time of measurement and logarithm of a thousandth time of measurement is 0.5 log Ω/□ or below.

2. The apparatus as claimed in claim 1, wherein said primary bias applying means is controlled by constant-voltage control.

3. The apparatus as claimed in claim 1, wherein when a volumetric resisitivity of said intermediate image transfer body is measured by a method that repeatedly applies a voltage v2 of 50 V for a period of time t3 of 60 seconds to said intermediate image transfer body and grounds said intermediate image transfer body for a period of time t4 of 10 seconds a number of times N2 of 1,000, a difference in absolute value between a logarithm of a first time of measurement and logarithm of a thousandth time of measurement is 2.1 log Ω·cm or below.

4. The apparatus as claimed in claim 3, wherein said primary bias applying means is controlled by constant-voltage control.

5. The apparatus as claimed in claim 1, wherein said secondary image transferring means comprises secondary bias applying means for applying a secondary image transfer bias to the other surface of said intermediate image transfer body.

6. The apparatus as claimed in claim 5, wherein when a volumetric resistivity of said intermediate image transfer body is measured by a method that repeatedly applies a voltage v2 of 50 V for a period of time t3 of 60 seconds to said intermediate image transfer body and grounds said intermediate image transfer body for a period of time t4 of 10 seconds a number of times N2 of 1,000, a difference in absolute value between a logarithm of a first time of measurement and logarithm of a thousandth time of measurement is 2.1 log Ω·cm or below.

7. The apparatus as claimed in claim 6, wherein said primary bias applying means is controlled by constant-voltage control.

8. The apparatus as claimed in claim 1, wherein said image carrier and said primary image transferring means comprise a plurality of image carriers and a plurality of primary image transferring means, respectively, and wherein toner images formed on said plurality of image carriers are sequentially transferred to said intermediate image transfer body one above the other by said plurality of primary image transferring means.

9. The apparatus as claimed in claim 8, wherein said secondary image transferring means comprises secondary bias applying means for applying a secondary image transfer bias to the other surface of said intermediate image transfer body.

10. The apparatus as claimed in claim 9, wherein when a volumetric resistivity of said intermediate image transfer body is measured by a method that repeatedly applies a voltage v2 of 50 V for a period of time t3 of 60 seconds to said intermediate image transfer body and grounds said intermediate image transfer body for a period of time t4 of 10 seconds a number of times N2 of 1,000, a difference in absolute value between a logarithm of a first time of measurement and logarithm of a thousandth time of measurement is 2.1 log Ω·cm or below.

11. The apparatus as claimed in claim 10, wherein said primary bias applying means is controlled by constant-voltage control.

12. A direct image transfer type of image forming apparatus comprising:

an image carrier;

a belt conveyor; and image transferring means for transferring a toner image formed on said image carrier to a recording medium being conveyed by said belt conveyor, said image transferring means comprising bias applying means for applying an image transfer bias to a reverse surface of said belt conveyor opposite to a surface conveying said recording medium;

wherein when a surface resistivity of said belt conveyor is measured by a method that repeatedly applies a voltage v1 of 200 V for a period of time t1 of 60 seconds to said belt conveyor and grounds said belt conveyor for a period of time t2 of 10 seconds a number of times N1 of 1,000, a difference in absolute value between a logarithm of a first time of measurement and logarithm of a thousandth time of measurement is 0.5 log Ω/□ or below.

13. The apparatus as claimed in claim 12, wherein when a volumetric resistivity of said belt conveyor is measured by a method that repeatedly applies a voltage v2 of 50 V for a period of time t3 of 60 seconds to said belt conveyor and grounds said belt conveyor for a period of time t4 of 10 seconds a number of times N2 of 1,000, a difference in absolute value between a logarithm of a first time of measurement and logarithm of a thousandth time of measurement is 2.1 log Ω·cm or below.

14. The apparatus as claimed in claim 12, wherein said image carrier and said image transferring means comprise a plurality of image carriers and a plurality of image transferring means, respectively, and wherein toner images formed on said plurality of image carriers are sequentially transferred to the recording medium one above the other by said plurality of image transferring means.

15. The apparatus as claimed in claim 14, wherein when a volumetric resistivity of said belt conveyor is measured by a method that repeatedly applies a voltage v2 of 50 V for a period of time t3 of 60 seconds to said belt conveyor and grounds said belt conveyor for a period of time t4 of 10 seconds a number of times N2 of 1,000, a difference in absolute value between a logarithm of a first time of measurement and logarithm of a thousandth time of measurement is 2.1 log Ω·cm or below.

16. An intermediate image transfer type of image forming apparatus comprising:

an image carrier;

an intermediate image transfer body to which a toner image is transferred from said image carrier;

primary image transferring means for transferring the toner image from said image carrier to said intermediate image transfer body; and secondary image transferring means for transferring the toner image from said intermediate image transfer body to a recording medium;

wherein said primary image transferring means comprises primary bias applying means for applying a primary image transfer bias to said intermediate image transfer body, and wherein said intermediate image transfer body has a surface potential attenuation ratio that attenuates, before a portion of said intermediate image transfer body applied with the primary image transfer bias is subject to a next primary image transfer, a potential remaining on said portion to a degree not disturbing said next primary image transfer.

17. The apparatus as claimed in claim 16, wherein said image carrier and said primary image transferring means comprise a plurality of image carriers and a plurality of primary image transferring means, respectively, and wherein toner images formed on said plurality of image carriers are sequentially transferred to said intermediate image transfer body one above the other by said plurality of primary image transferring means.

18. The apparatus as claimed in claim 17, a surface of said intermediate image transfer body to which the primary image transfer bias or a secondary image transfer bias is applied has a surface resistivity ranging from $10^7$ Ω/□ to $10^{12}$ Ω/□.

19. The apparatus as claimed in claim 18, wherein a maximum amount of toner to deposit on a line portion included in a single-color toner image, which is transferred to said intermediate image transfer body, is 0.7 mg/cm$^2$.

20. The apparatus as claimed in claim 19, wherein the toner comprises spherical toner, and wherein assuming that the maximum amount of toner to deposit on the line portion of the single-color toner image and a maximum amount of toner to deposit on a solid portion of said toner image are a mg/cm$^2$ and b mg/cm$^2$, respectively, a ratio a/b lies in a range of $$1.0 \leqq a/b \leqq 1.6.$$

21. The apparatus as claimed in claim 19, wherein the toner comprises spherical toner, and wherein assuming that the maximum amount of toner to deposit on the line portion of the single-color toner image and a maximum amount of toner to deposit on a solid portion of said toner image are a mg/cm$^2$ and b mg/cm$^2$, respectively, a ratio a/b lies in a range of $$1.0 \leqq a/b \leqq 1.4.$$

22. The apparatus as claimed in claim 19, wherein the toner comprises spherical toner.

23. The apparatus as claimed in claim 22, wherein the spherical toner has a mean circularity of 0.95 or above.

24. The apparatus as claimed in claim 22, wherein said intermediate image transfer body has a single-layer structure.

25. The apparatus as claimed in claim 24, wherein said intermediate image transfer body comprises a surface layer at least at a side thereof to which the toner image is transferred.

26. The apparatus as claimed in claim 25, wherein said surface layer is formed of any one of a fluorine resin, a silicone resin and a fluorine-containing material.

27. The apparatus as claimed in claim 16, wherein said intermediate image transfer body has a surface potential attenuation ratio that attenuates a potential remaining on a portion of said intermediate image transfer body applied with the primary image transfer bias $V_0$ to $V_0/2$ in 5 seconds.

28. The apparatus as claimed in claim 27, wherein said image carrier and said primary image transferring means comprise a plurality of image carriers and a plurality of primary image transferring means, respectively, and wherein toner images formed on said plurality of image carriers are sequentially transferred to said intermediate image transfer body one above the other by said plurality of primary image transferring means.

29. The apparatus as claimed in claim 28, a surface of said intermediate image transfer body to which the primary image transfer bias or a secondary image transfer bias is applied has a surface resistivity ranging from $10^7$ Ω/□ to $10^{12}$ Ω/□.

30. The apparatus as claimed in claim 29, wherein a maximum amount of toner to deposit on a line portion included in a single-color toner image, which is transferred to said intermediate image transfer body, is 0.7 mg/cm$^2$.

31. The apparatus as claimed in claim 30, wherein the toner comprises spherical toner, and wherein assuming that the maximum amount of toner to deposit on the line portion of the single-color toner image and a maximum amount of toner to deposit on a solid portion of said toner image are a mg/cm$^2$ and b mg/cm$^2$, respectively, a ratio a/b lies in a range of $$1.0 \leqq a/b \leqq 1.6.$$

32. The apparatus as claimed in claim 30, wherein the toner comprises spherical toner, and wherein assuming that the maximum amount of toner to deposit on the line portion of the single-color toner image and a maximum amount of toner to deposit on a solid portion of said toner image are a mg/cm$^2$ and b mg/cm$^2$, respectively, a ratio a/b lies in a range of $$1.0 \leqq a/b \leqq 1.4.$$

33. The apparatus as claimed in claim 30, wherein the toner comprises spherical toner.

34. The apparatus as claimed in claim 33, wherein the spherical toner has a mean circularity of 0.95 or above.

35. The apparatus as claimed in claim 33, wherein said intermediate image transfer body has a single-layer structure.

36. The apparatus as claimed in claim 35, wherein said intermediate image transfer body comprises a surface layer at least at a side thereof to which the toner image is transferred.

37. The apparatus as claimed in claim 36, wherein said surface layer is formed of any one of a fluorine resin, a silicone resin and a fluorine-containing material.

38. The apparatus as claimed in claim 16, wherein assuming that a period of time between preceding primary image transfer and following image transfer is T seconds, said intermediate image transfer body has a surface potential attenuation ratio that attenuates a potential remaining on a portion of said intermediate image transfer body applied with the primary image transfer bias $V_0$ to $V_0/2$ or below in T seconds.

39. The apparatus as claimed in claim 38, wherein said image carrier and said primary image transferring means comprise a plurality of image carriers and a plurality of primary image transferring means, respectively, and wherein toner images formed on said plurality of image carriers are sequentially transferred to said intermediate image transfer body one above the other by said plurality of primary image transferring means.

40. The apparatus as claimed in claim 39, a surface of said intermediate image transfer body to which the primary or the secondary image transfer bias is applied has a surface resistivity ranging from $10^7$ Ω/□ to $10^{12}$ Ω/□.

41. The apparatus as claimed in claim 40, wherein a maximum amount of toner to deposit on a line portion included in a single-color toner image, which is transferred to said intermediate image transfer body, is 0.7 mg/cm$^2$.

42. The apparatus as claimed in claim 41, wherein the toner comprises spherical toner, and wherein assuming that the maximum amount of toner to deposit on the line portion of the single-color toner image and a maximum amount of toner to deposit on a solid portion of said toner image are a mg/cm$^2$ and b mg/cm$^2$, respectively, a ratio a/b lies in a range of $1.0 \leqq a/b \leqq 1.6$.

43. The apparatus as claimed in claim 41, wherein the toner comprises spherical toner, and wherein assuming that the maximum amount of toner to deposit on the line portion of the single-color toner image and a maximum amount of toner to deposit on a solid portion of said toner image are a mg/cm$^2$ and b mg/cm$^2$, respectively, a ratio a/b lies in a range of $1.0 \leqq a/b \leqq 1.4$.

44. The apparatus as claimed in claim 41, wherein the toner comprises spherical toner.

45. The apparatus as claimed in claim 44, wherein the spherical toner has a mean circularity of 0.95 or above.

46. The apparatus as claimed in claim 44, wherein said intermediate image transfer body has a single-layer structure.

47. The apparatus as claimed in claim 46, wherein said intermediate image transfer body comprises a surface layer at least at a side thereof to which the toner image is transferred.

48. The apparatus as claimed in claim 47, wherein said surface layer is formed of any one of a fluorine resin, a silicone resin and a fluorine-containing material.

49. An intermediate image transfer type of image forming apparatus comprising:

an image carrier;

an intermediate image transfer body to which a toner image is transferred from said image carrier;

primary image transferring means for transferring the toner image from said image carrier to said intermediate image transfer body; and secondary image transferring means for transferring the toner image from said intermediate image transfer body to a recording medium;

wherein said primary image transferring means comprises primary bias applying means for applying a primary image transfer bias to said intermediate image transfer body, wherein said secondary image transferring means comprises secondary bias applying means for applying a secondary image transfer bias to said intermediate image transfer body, and wherein said intermediate image transfer body has a surface potential attenuation ratio that attenuates, before a portion of said intermediate image transfer body applied with the secondary image transfer bias is subject to a next primary image transfer, a potential remaining on said portion to a degree not disturbing said next primary image transfer.

50. The apparatus as claimed in claim 49, wherein said intermediate image transfer body has a surface potential attenuation ratio that attenuates a potential remaining on a portion of said intermediate image transfer body applied with the secondary image transfer bias $V_1$ to $V_1/2$ in 5 seconds.

51. The apparatus as claimed in claim 50, a surface of said intermediate image transfer body to which the primary or the secondary image transfer bias is applied has a surface resistivity ranging from $10^7$ Ω/□ to $10^{12}$ Ω/□.

52. The apparatus as claimed in claim 51, wherein a maximum amount of toner to deposit on a line portion included in a single-color toner image, which is transferred to said intermediate image transfer body, is 0.7 mg/cm$^2$.

53. The apparatus as claimed in claim 52, wherein the toner comprises spherical toner, and wherein assuming that the maximum amount of toner to deposit on the line portion of the single-color toner image and a maximum amount of toner to deposit on a solid portion of said toner image are a mg/cm$^2$ and b mg/cm$^2$, respectively, a ratio a/b lies in a range of $$1.0 \leqq a/b \leqq 1.6.$$

54. The apparatus as claimed in claim 52, wherein the toner comprises spherical toner, and wherein assuming that the maximum amount of toner to deposit on the line portion of the single-color toner image and a maximum amount of toner to deposit on a solid portion of said toner image are a mg/cm$^2$ and b mg/cm$^2$, respectively, a ratio a/b lies in a range of $$1.0 \leqq a/b \leqq 1.4.$$

55. The apparatus as claimed in claim 52, wherein the toner comprises spherical toner.

56. The apparatus as claimed in claim 55, wherein the spherical toner has a mean circularity of 0.95 or above.

57. The apparatus as claimed in claim 55, wherein said intermediate image transfer body has a single-layer structure.

58. The apparatus as claimed in claim 57, wherein said intermediate image transfer body comprises a surface layer at least at a side thereof to which the toner image is transferred.

59. The apparatus as claimed in claim 58, wherein said surface layer is formed of any one of a fluorine resin, a silicone resin and a fluorine-containing material.

60. The apparatus as claimed in claim 49, wherein assuming that a period of time between secondary image transfer and primary image transfer following said secondary image transfer is U seconds, said intermediate image transfer body has a surface potential attenuation ratio that attenuates a potential remaining on a portion of said intermediate image transfer body applied with the secondary image transfer bias $V_1$ to $V_2/2$ or below in T seconds.

61. The apparatus as claimed in claim 60, a surface of said intermediate image transfer body to which the primary or the secondary image transfer bias is applied has a surface resistivity ranging from $10^7$ Ω/□ to $10^{12}$ Ω/□.

62. The apparatus as claimed in claim 61, wherein a maximum amount of toner to deposit on a line portion included in a single-color toner image, which is transferred to said intermediate image transfer body, is 0.7 mg/cm$^2$.

63. The apparatus as claimed in claim 62, wherein the toner comprises spherical toner, and wherein assuming that the maximum amount of toner to deposit on the line portion of the single-color toner image and a maximum amount of toner to deposit on a solid portion of said toner image are a mg/cm$^2$ and b mg/cm$_2$, respectively, a ratio a/b lies in a range of $$1.0 \leqq a/b \leqq 1.6.$$

64. The apparatus as claimed in claim 62, wherein the toner comprises spherical toner, and wherein assuming that the maximum amount of toner to deposit on the line portion of the single-color toner image and a maximum amount of toner to deposit on a solid portion of said toner image are a mg/cm$^2$ and b mg/cm$^2$, respectively, a ratio a/b lies in a range of $$1.0 \leqq a/b \leqq 1.4.$$

65. The apparatus as claimed in claim 62, wherein the toner comprises spherical toner.

66. The apparatus as claimed in claim 65, wherein the spherical toner has a mean circularity of 0.95 or above.

67. The apparatus as claimed in claim 65, wherein said intermediate image transfer body has a single-layer structure.

68. The apparatus as claimed in claim 67, wherein said intermediate image transfer body comprises a surface layer at least at a side thereof to which the toner image is transferred.

69. The apparatus as claimed in claim 68, wherein said surface layer is formed of any one of a fluorine resin, a silicone resin and a fluorine-containing material.

* * * * *